US010267565B1

(12) United States Patent
Quesada Saborio

(10) Patent No.: US 10,267,565 B1
(45) Date of Patent: Apr. 23, 2019

(54) SPIRAL HEAT EXCHANGER COILS

(71) Applicant: Carlos Quesada Saborio, San Jose (CR)

(72) Inventor: Carlos Quesada Saborio, San Jose (CR)

( * ) Notice: Subject to any disclaimer, the term of this patent is extended or adjusted under 35 U.S.C. 154(b) by 701 days.

(21) Appl. No.: 14/665,756

(22) Filed: Mar. 23, 2015

Related U.S. Application Data

(60) Provisional application No. 61/968,815, filed on Mar. 21, 2014.

(51) Int. Cl.
*F28D 7/04* (2006.01)
*F28D 7/02* (2006.01)
*F28D 1/047* (2006.01)

(52) U.S. Cl.
CPC ..... *F28D 7/04* (2013.01); *F28D 1/0472* (2013.01); *F28D 1/0473* (2013.01); *F28D 7/024* (2013.01); *F28D 7/028* (2013.01)

(58) Field of Classification Search
CPC ..... F28D 1/0473; F28D 1/0472; F28D 7/04; F28D 7/028; F28D 2001/0273; F28D 2001/0266; F28D 7/022; F28D 7/024; F28D 7/026; F28D 7/02; F28F 1/02; F28F 1/025; F28F 1/126; F28F 13/06; F28F 13/12; F28F 2250/10; F28F 2210/08; F24H 1/43; B21D 11/06
USPC ..... 165/156, 184, 146, 125
See application file for complete search history.

(56) References Cited

U.S. PATENT DOCUMENTS 2,813,708 A * 11/1957 Frey ..... F27B 3/26 138/39
3,077,226 A * 2/1963 Matheny ..... F28B 1/06 165/125
3,612,004 A * 10/1971 Cancilla ..... F22B 21/34 122/230
4,542,786 A * 9/1985 Anders ..... F28D 1/05366 165/144
7,849,915 B2 * 12/2010 Kawakubo ..... F28F 1/022 165/177
2008/0277095 A1 * 11/2008 Zhai ..... F25B 39/00 165/80.4

FOREIGN PATENT DOCUMENTS

DE 2209325 A1 9/1973
DE 202008006379 U1 7/2008
DE 102009001720 A1 * 9/2010 ..... B21D 11/06

(Continued)

*Primary Examiner* — Christopher R Zerphey
*Assistant Examiner* — For K Ling
(74) *Attorney, Agent, or Firm* — James Creighton Wray; Meera P. Narasimhan

(57) ABSTRACT

Interlaced tubing elements form a spiral shaped heat exchange element. The tubing elements are tilted while being helically wound, forming a substantially overall cylinder or cone spiral structure having a central longitudinal axis. Tubing elements are tilted with respect to the central longitudinal axis, and may be continuously tilted or variably tilted. A heat exchange element is formed by a continuous tubing element that spirals around a central longitudinal axis, or by several interlaced tubing elements that are spaced adjacent to each other in a conic spiral shape. The tubing elements may have a plurality of fins on at least one of the outer surfaces or first and/or second side walls.

31 Claims, 34 Drawing Sheets

(56) References Cited

FOREIGN PATENT DOCUMENTS

| | | | | | |
|---|---|---|---|---|---|
| EP | 0640803 | A1 | | 3/1995 | |
| EP | 1840494 | A2 | | 10/2007 | |
| GB | 1390782 | A | | 4/1975 | |
| JP | 2004218954 | A | | 8/2004 | |
| WO | WO 8001104 | A1 | * | 5/1980 | ..... F16J 15/00 |
| WO | WO 2011002711 | A1 | * | 1/2011 | ..... F24H 1/40 |

* cited by examiner

FIXEDLY TILTED
SPIRAL
HEAT EXCHANGER TUBE
(1/2 LOOP)

FIXEDLY TILTED (constant ∠ β)
SPIRAL REFERENCES

SIDE VIEW

CONTINUOUS LOOP (one tube)
CONSTANT TILT TUBE
forming a
CONIC SPIRAL COIL

ISOMETRIC VIEW

CONTINUOUS LOOP
CONSTANT TILT TUBE
CONIC SPIRAL COIL

SAME PRINCIPLE / VARIOUS TUBE SHAPES

8

1/2 LOOP
CONSTANT TILT
SPIRAL
HEAT EXCHANGER TUBE

SAME UPPER DIAMETER
DIFFERENTE LOWER DIAMETER
(different ∠ δ)

SPIRAL REFERENCES

SIDE VIEW

CONTINUOUS LOOP (one tube)
VARIABLE TILT TUBE
forming a
CONIC SPIRAL COIL

ISOMETRIC VIEW

CONTINUOUS LOOP
VARIABLE TILT TUBE
CONIC SPIRAL COIL

1/2 LOOP
VARIABLE TILT
SPIRAL
HEAT EXCHANGER TUBE

SIDE VIEW

ISOMETRIC VIEW

COIL CUT VIEW COMPARISON

SPIRAL HEAT EXCHANGER COILS

This application claims the benefit of U.S. Provisional Application No. 61/968,815 filed Mar. 21, 2014, which is hereby incorporated by reference in its entirety as if fully set forth herein.

BACKGROUND OF THE INVENTION

The present invention relates to heat exchangers having one or several substantially flat and rigid elongated tubing elements.

In the technical field of heat exchangers such as evaporators, condensers and radiators and coolers there have been many attempts to provide compact and energy efficient heat exchangers. A heat exchanger is hereby generally known to provide for an exchange of thermal energy between a first medium such as, for example, water and/or a cooling agent, and a second medium such as, for example, air.

For instance, EP 1 840 494 A2 discloses a heat exchanger, whereby the heat exchanger comprises a profile having two flat tubes with several channels and whereby the tubes are connected by means of a bar. The profile is a one-piece profile and may consist of aluminium or an aluminium alloy.

Moreover, DE 20 2008 006 379 U1 discloses an aluminium or aluminium alloy profile, which can be used for tubes for heat exchangers. The profile has a central channel and several further channels arranged around the central channel.

DE 2 209 325 discloses a tube for heat exchangers having a helical structure. Furthermore, DE 2 209 329 discloses heat exchanger tubes having ribs on the inner side and the outer side of the tube.

Additionally, GB 1 390 782 discloses a heat-exchange tubing having spaced metal fins projecting inwardly of the tubing from the wall sections of the tubing and extending longitudinally of the tubing.

Further, EP 0 640 803 A1 relates to heat transfer coil, where a second piece of tubing is wound around the first piece of tubing while the first piece is straight and where the first piece of tubing is then formed to define the overall coil shape and then the first and second pieces of tubing internally sized by internal pressurization to also force the two pieces of tubing to intimate contact with each other.

JP 2004 218954 A relates to a heat exchanger, whereby two flat tubes can be carried out spirally at the same diameter and form a substantially overall cylindrical structure. The flat tube is bent in direction of the major axis and interposition fixing of the fin is carried out at the gap between the opposite planes.

However, it is still desirable to improve the already known technical solutions in the field of heat exchangers.

Needs exist for improved heat exchangers.

SUMMARY OF THE INVENTION

It is therefore an object for the present invention to improve heat exchangers, in particular in that the efficiency of the heat exchanges increases and that the overall structure of the heat exchangers is improved and simplified and allows a more compact structure of the heat exchanger means.

The above object is solved according to the present invention by heat exchanger means with a conic spiral shape. Accordingly, a heat exchanger means comprising several substantially flat and rigid elongated tubing elements is provided, whereby the tubing elements form a substantially overall cylindrical structure having a central longitudinal axis, and the tubing elements are spirally curved around the central longitudinal axis and interleaved in the structure, whereby the tubing elements have a plurality of fins in at least one of the outer surfaces of the first side wall and/or of the second side wall and whereby the fins are at least partially covered by covering wall, whereby the tubing elements are at least partially tilted or at least partially tilted and sloped and at least partially helically wound and are twisted so as to form at least a part of a conic spiral structure.

The conic spiral shape of this disclosure may refer to a variety of different shapes, all of which may refer to a curve that turns around an axis at a constant or continuously varying distance while moving parallel to the axis.

The conic spiral shape may allow control over heat exchange or air flow through the tube based on the angle of tilt of the spiral shape, allowing for more balanced cooling operation. The conic spiral shape has the added benefit of controlling air or liquid pressure through the tube. It may also prevent recirculation of air or liquid entering into one end of the spiral.

The tubing element, having a plurality of fins on at least one of the outer surfaces of the first side wall and/or of the second side wall and whereby the fins are at least partially covered by a covering wall, increases the tubing element surface for a better heat exchange between said second medium, such as air, and the heat exchanger.

The opening of the tubing element may vary across the opening. In some embodiments, the opening is an elongated tear drop shape or a crescent shape. This shape serves to control air flow over the tube.

The interior volume of the tubing element may be subdivided into a plurality of microtubes, which may facilitate high pressures of liquids or gasses passing through the tubes. Alternatively, the tubing element may consist of one continuous open volume to allow a more rapid passage of gasses or liquids.

The conic spiral shaped structure of the tubing element is determined merely by variables radius r, angle $\alpha$, and angle $\beta$. Radius r defines the distance between the centre of the tubing element and the central longitudinal axis X of the heat exchanger. Angle $\alpha$ defines the slope of the tubing element and extends between the central longitudinal axis X of the heat exchanger and the central axis Z of the tubing element. Angle $\beta$ defines the tilt of the tubing element and extends between the central longitudinal axis X of the heat exchanger and the central transversal axis Y of the tubing element.

Therefore, due to the tilted orientation of the tubing element, there are almost no horizontal surfaces of the tubing element within the heat exchanger. Natural condensate from air moisture disappears very quickly, because of the tilted surfaces that result from each tube element being tilted while at least partially helically wound and twisted. Natural condensate from air moisture disappears to the outside surface of the heat exchanger, because of the sloped surfaces tilted orientation of the tubing element. So, freezing of condensate from air moisture between each of said tubing elements can be eliminated or minimized.

Compared to the prior art, the tubing element, being tilted while at least partially helically wound and twisted so as to form at least a part of a helical structure, is more efficient with less material. Also the heat exchanger needs a smaller volume in the whole heat exchanger system, due to the compact set of tubing elements.

Further, this tubing element, being tilted while being at least partially helically wound and/or twisted so as to form at least a part of a conic spiral structure, effects a better interaction between a second medium such as air and the surface of the tubing element, due to the tilted orientation of the tubing element.

Such a tubing element for a heat exchanger may be an elongated heat exchanger microchannel tube. Such an elongated heat exchanger microchannel tube may have a first and a second open end. There may be relatively large parallel opposite side walls of the microchannel tube with generally flat surfaces, which are joined with relatively small opposite edge walls between the side walls. These edge walls may be convexly curved.

Heat transfer vapor or fluid may fill a heat exchanger microchannel tube and may flow from one end of the microchannel tube to the other end. The term microchannel is also known as microport.

A second medium such as air may flow around the outer sides of the tubing element and may transport the heat from the tube away or vice versa.

By providing a plurality of fins on at least one of the outer surfaces of the first side wall and/or of the second side wall the surface for heat exchange is increased. Thus, also the efficiency of the heat exchanger may be significantly improved.

Moreover, it is possible that the width of the first side wall and the second side wall is approximately at least 10 times larger than the distance between the first side wall and the second side wall and/or that the first side wall and second side wall are connected respectively on both sides by a rounded connection wall.

The width of the first side wall and/or the second side wall may be equal and/or chosen within a range of about 10 mm to about 30 mm. Preferably, the width of the first side wall and/or the second side wall may be about 15 mm.

The distance between the first side wall and the second side wall may be chosen respectively, i.e. within a range of about 1 mm to about 3 mm. Preferably the distance may be about 1.5 mm.

Additionally, it is possible that the tubing element is at least partially tilted or at least partially tilted and sloped and at least partially helically wound and twisted so as to form at least a part of a conic spiral structure, whereby preferably the conic spiral structure has an overall cylindrical structure and that the helical structure is formed in a cylindrical shape.

In particular, the structure according to the present invention of heat exchangers allows a more efficient heat exchange and a more compact structure of heat exchangers.

The heat exchanger may be embodied as a heat exchanger.

It is possible that the fins are arranged between the covering wall and at least one of the outer surfaces of the first side wall and/or of the second side wall and that the covering wall and the outer surface are substantially parallel.

Furthermore, it is possible that the interleaved tubing elements are arranged one upon the other.

The first ends of adjacent tubing elements may be connected by a connecting means, whereby preferably the connecting means is a connector tubing element, which is for instance at least partially bent in a U-shape.

Additionally, the second ends of adjacent tubing elements may be connected by a connecting means, whereby preferably the connecting means comprises plurality of connector tubing elements and a central connector portion, whereby for instance the connector tubing elements and the central connector portion are arranged in star-shaped manner.

Moreover, it is possible that the tubing element has a plurality of fins on both of the outer surfaces of the first side wall and of the second side wall.

The fins may be monoblock fins.

Further, the fins may be perpendicularly arranged on the at least one of the outer surfaces of the first side wall and/or of the second side wall.

It is possible that the fins are inclined arranged on the at least one of the outer surfaces of the first side wall and/or of the second side wall, whereby exemplarily the angle between the fins and the outer surface is substantially perpendicular.

Additionally, the fins may merely extend along the whole width of at least one of the outer surfaces of the first side wall and/or of the second side wall and/or are curved.

Furthermore, it is possible that the fins are arranged along a curve extending along the whole width of at least one of the outer surfaces of the first side wall and/or of the second side wall and/or are curved, whereby between the fins being arranged along a curve is a pitch and/or gap.

It is possible that the fins are arranged in a plurality of rows, preferably substantially parallel rows and/or preferably along at least a part of the length of the tubing element.

Further, the tubing elements may comprise at least one microchannel, preferably several microchannels with a round or circular cross-section and/or several microchannels with an angular cross-section, exemplarily several microchannels with a triangular cross-section and/or several microchannels with quadrangular cross-section are provided.

Additionally, at least some of the microchannels may be arranged with an off-set to each other, whereby exemplarily all microchannels are arranged with an off-set to each other, whereby preferably the off-set causes chamfers and/or grooves within the first side wall and/or the second side wall.

Moreover, it is possible that the heat exchangers are condensers or evaporators or radiators or coolers.

Further, the present invention relates to a tubing element with air or liquid flow. Accordingly, a tubing element for a heat exchanger is provided comprising the tubing element features as arranged in a fraction of a loop of a spiral and have constant or varies slopes.

Further details and advantages of the present invention shall be described herein after with respect to the drawings.

A heat exchanger has multiple interlaced long tubes having cross-sections that are relatively wide and relatively thin. The tubes have inner spaces, relatively wide outer side surfaces and relatively narrow outer edge surfaces. The long tubes are adapted for passing a first heat exchange fluid into the first ends, through the tubes and out of the second ends. The interlaced tubes are tilted and formed into a spiral having a central longitudinal axis. Outer side surfaces of the interlaced tubes are spaced apart and are tilted with respect to the central axis. A second heat exchange fluid flows over the spaced outer side surfaces and through spaces formed between the spaced outer side surfaces of the tubes.

One spiral is formed as a cylinder around the longitudinal central axis.

Preferably the spiral is formed about and constantly recedes from or moves towards the longitudinal central axis. The spiral is formed in a conical shape, and the outer surfaces of the long multiple interlaced tubes extend through the conical shape.

The long tubes are twisted around longitudinal axes of the tubes. Angles or slopes of portions of the outer side surfaces of the tubes vary with respect to their varied positions along the longitudinal central axis of the conical shape. The outer side surfaces near the first smaller diameter end are at smaller acute angles to the central axis. The outer surfaces near the second larger diameter end are at larger acute angles with respect to the longitudinal central axis. Angles of the portions of the outer side surfaces nearer the smaller end of the conical shape are more axial than radial to the central axis. Angles of the portions of the outer side surfaces nearer the larger end of the conical shape are more radial than axial to the longitudinal central axis. The second heat transfer fluid flows inward through spaces between outer side surfaces of the tubes near the smaller end of the conical shape in a direction more axial than radial to the longitudinal central axis. The second heat transfer fluid flows inward through spaces between outer side surfaces near the larger end of the conical shape in a direction more radial than axial to the central axis.

A new method provides a heat exchanger with multiple spaced apart interlaced long tubes having cross-sections that are relatively wide and relatively thin. The tubes have inner spaces, relatively wide outer side surfaces and relatively narrow outer edge surfaces. Tilting the interlaced tubes and forming the interlaced tubes into a spiral forms a conical shape having a smaller first end and a larger second end. Outer side surfaces of the interlaced tubes are spaced apart and tilted with respect to the central axis. A first heat exchange fluid is passed into the first ends, through the tubes and out of the second ends. A second heat exchange fluid flows over the spaced outer side surfaces and in a direction of the central axis and outward through the second larger end.

The tilting further comprises tilting the outer side surfaces of the tubes with respect to the central axis. Twisting the long tubes about longitudinal axes of the tubes occurs before interlacing the tubes. The tilting and twisting vary the tilting of the outer side surfaces with respect to the central axis.

The tilting further includes tilting the outer side surfaces of the tube at increasing obtuse angles and decreasing acute angles from the larger second end to the smaller first end.

These and further and other objects and features of the invention are apparent in the disclosure, which includes the above and ongoing written specification, with the claims and the drawings.

DETAILED DESCRIPTION

Figure 1:
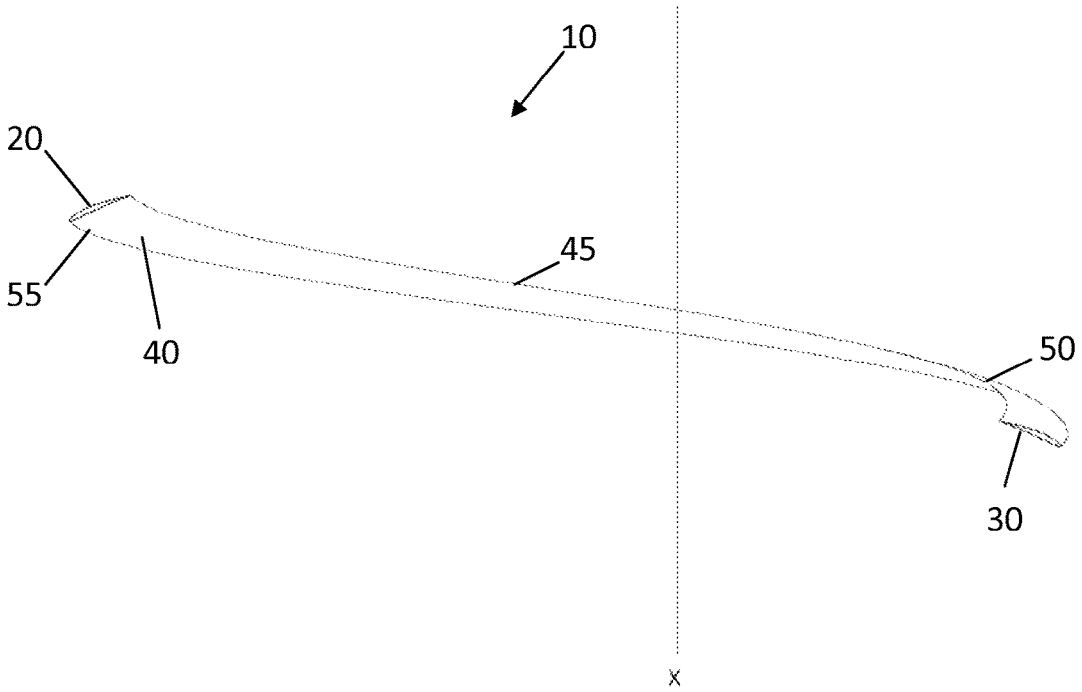
FIG. 1 is a perspective view of a tubing element according to the present invention in a first embodiment of a continuously tilted and twisted spiral.

FIG. 1 shows the perspective view of a first embodiment of the tubing element 10. The tubing element 10 is a rigid elongated heat exchanger tube 10 having a first end 20 and a second end 30. The tubing element 10 is in a continuously tilted spiral shape.

There are relatively large parallel opposite side walls 40 and 50 with generally flat surfaces. The opposite parallel arranged side walls 40, 50 of the tubing element are joined with relatively small opposite edge walls 45, 55, which are rounded connection walls 45, 55. The tubing element 10 is partially tilted and also helically wound and/or twisted so as to form at least a part of a conic spiral structure.

The opening at ends 20 and 30 is varies in width and has the smallest opening distance near the connecting walls 45 and 55. The width of the opening between the first side wall 40 and the second side wall 50 is considerably smaller than the width of the side walls 40, 50.

The opposite side walls 40 and 50 of the tubing element 10 are oppositely disposed in general parallel planes in the helix within the tube 10 there may be one or more media flow channels, which are formed between the oppositely disposed side walls 40, 50. The media flow channels are angularly disposed with respect to the axis. A heat transfer vapor or fluid such as water or oil or any refrigerant (liquid or vapor refrigerant) fills the tubing element 10 and flows from one end 20 of the tubing element 10 to the other end 30. Preferably, the resulting helix of the tubing element 10 is formed in a conic spiral coil (see e.g. FIG. 7 (continuously) and FIG. 9 (partial loop)).

Figure 2:
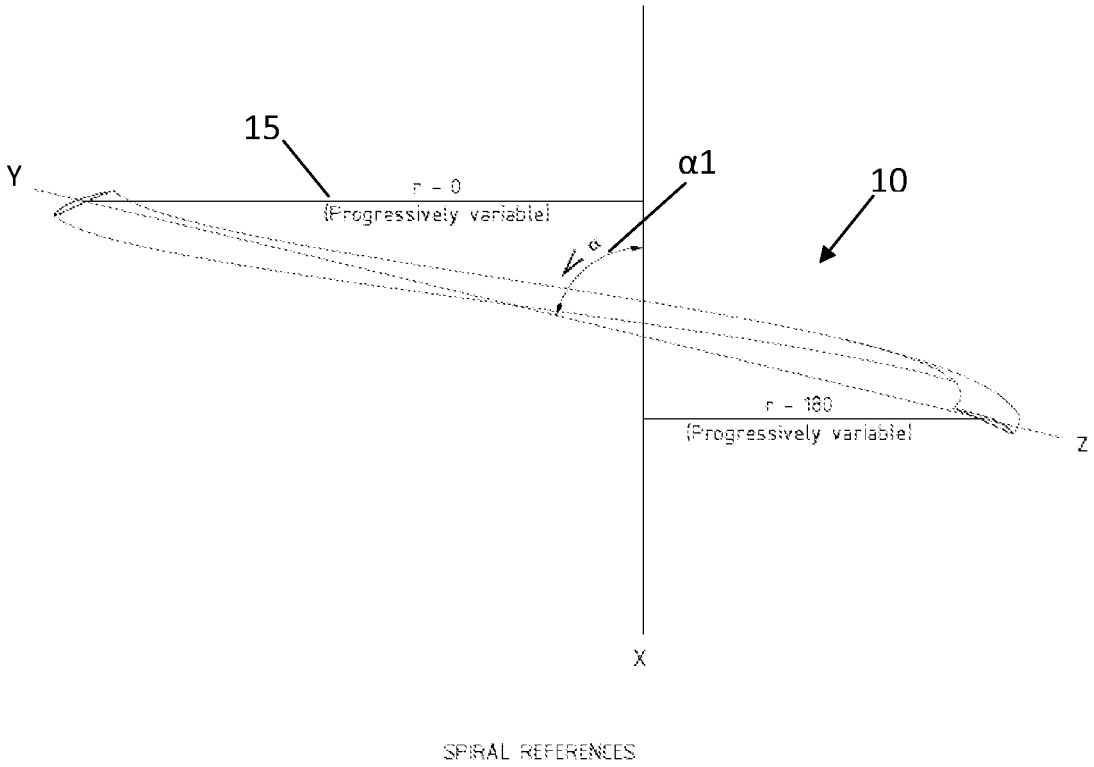
FIG. 2 is a further perspective view of tubing element shown in FIG. 1 showing the radii and angles for the tubing element.

FIG. 2 shows the defining the radius 15 of the helix and an angle $\alpha 1$ defining the rise in the tubing element 10 coil. The radius 15 is progressively variable, meaning that the radius 14 decreases as the heat exchanger coil 100 progresses along its length.

Figure 3:
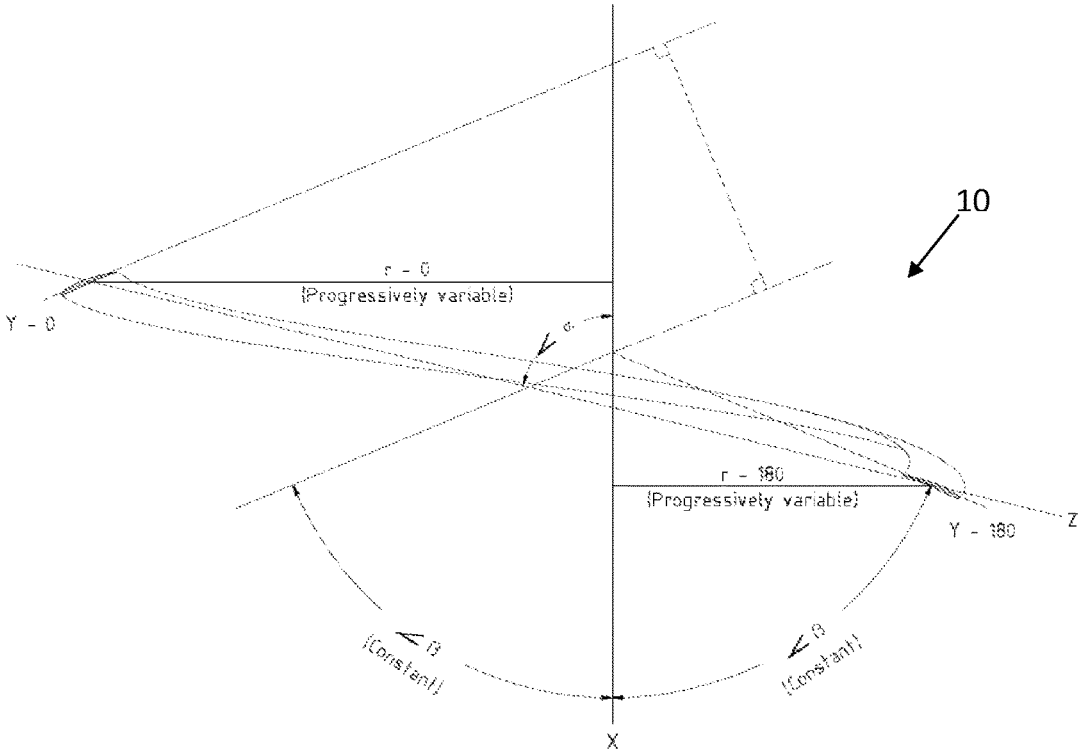
FIG. 3 is a further perspective view of tubing element shown in FIG. 1 showing the angles for the slope and the tilt of the tubing element.

FIG. 3 shows the defining angles, i.e. angle $\alpha$ defining the slope and angle $\beta$ defining the tilt. The twist of the tubing element 10 is determined merely by variables radius r, angle $\alpha$ defining the slope and angle $\beta$ defining the tilt. Radius r defines the distance between the center of the tubing element 10 at the intersection of the central axis Z and the central transverse axis Y, both of the tubing element 10 and the central longitudinal axis X of the heat exchanger 100. Angle $\alpha$ defines the slope of the tubing element 10 and extends between the central longitudinal axis X of the heat exchanger 100 and the central axis Z of the tubing element 10. Angle $\beta$ defines the tile of the tubing element 10 and extends between the central longitudinal axis Y of the heat exchanger 100 and the central transverse axis Y of the tubing element 10.

The tubing element 10 is an elongated heat exchanger microchannel tube. The heat exchanger microchannel tube may be longitudinally curved around a central axis X into a conic spiral shape. This axis X is shown in FIG. 3 and is the central axis X of the overall and imaginary cylindrical shape of the conic spiral.

Figure 4:
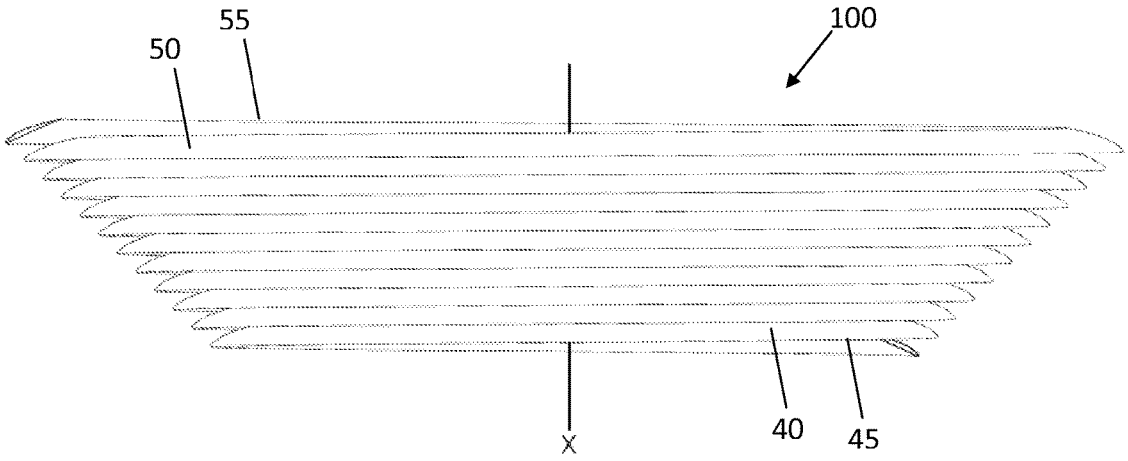
FIG. 4 is a side elevation view of a constantly tilted tube in a continuous loop forming a conic spiral coil.

FIG. 4 is a side elevation of a constantly tilted tube element that is tilted and twisted into a conic spiral coil of a heat exchanger 100. The single tubing element 10 is made of a heat transfer material, usually aluminum. This heat transfer material is rolled and formed into a sloped and tilted continuous conic spiral shape.

Tube 10 has, as already discussed above, parallel side walls 40, 50 and the connecting walls 45, 55 which appear as curved edges. The tubing element is twisted to a desirable tilt and formed into the continuous conic spiral shape. The tube may have a plurality of adjacent small parallel internal channels with circular, angular, rectangular, square or more preferably circular cross sections (see e.g. FIG. 8).

Figure 5:
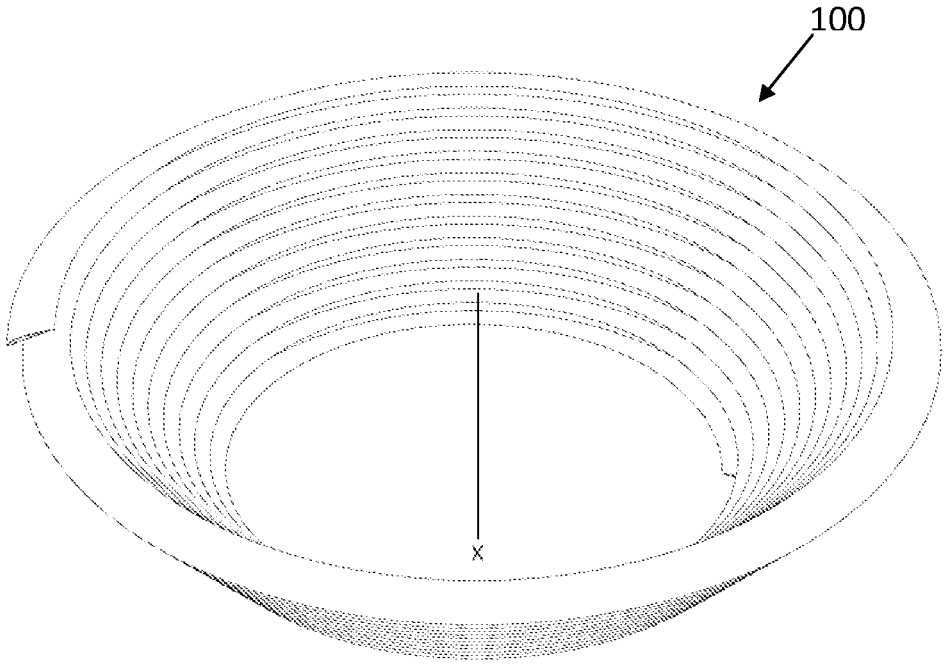
FIG. 5 is an isometric view of a constantly tilted tube in a continuous loop forming a conic spiral coil.

The heat transfer vapor or fluid flows through the channels and transfers heat through the tube bodies to the tube walls 40, 50 and edges 45, 55, from where heat is transferred between the walls and the surrounding medium or vice versa, such as e.g. already shown in FIG. 5, the walls 40, 50 may be scored, grooved or dimpled to increase the heat transfer surfaces.

FIG. 5 is an isometric view of a constantly tilted tube in a continuous loop forming a conic spiral coil.

Figure 6:
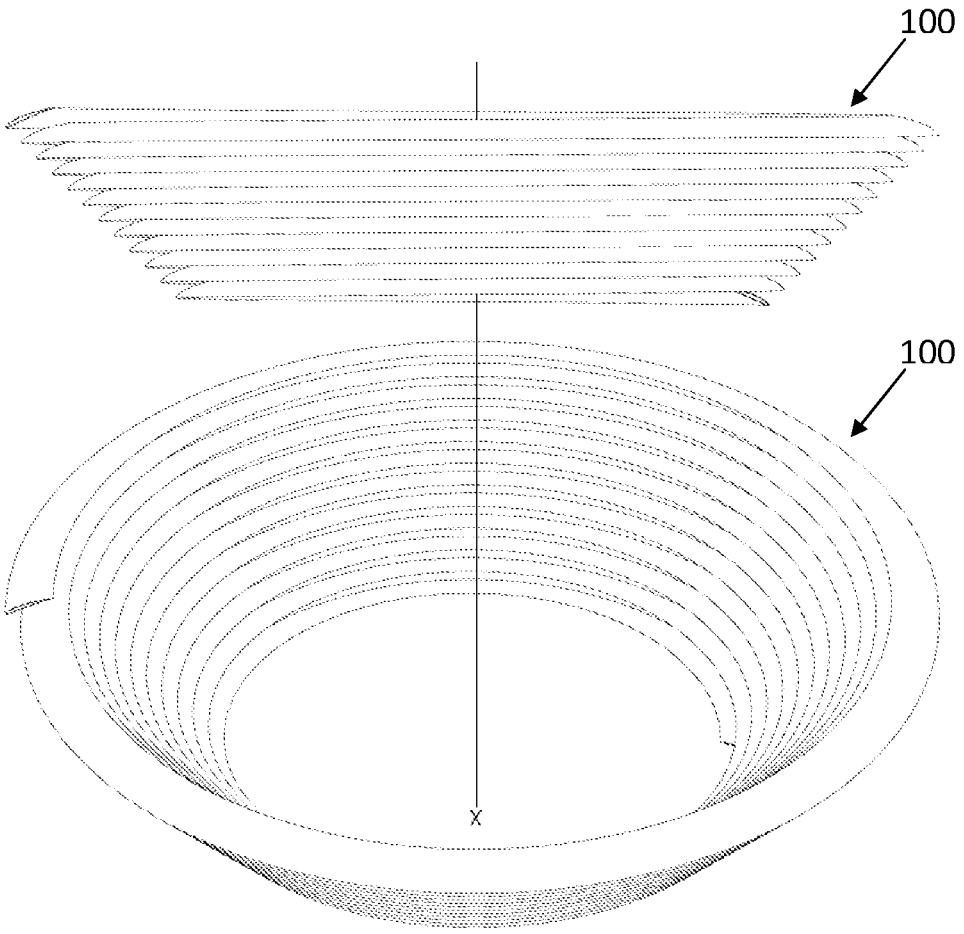
FIG. 6 shows a comparison of the side elevation and isometric views of a constantly tilted tube in a continuous loop forming a conic spiral coil.

FIG. 6 shows a comparison of the side elevation and isometric views of a constantly tilted tube in a continuous loop forming a conic spiral coil.

Figure 7:
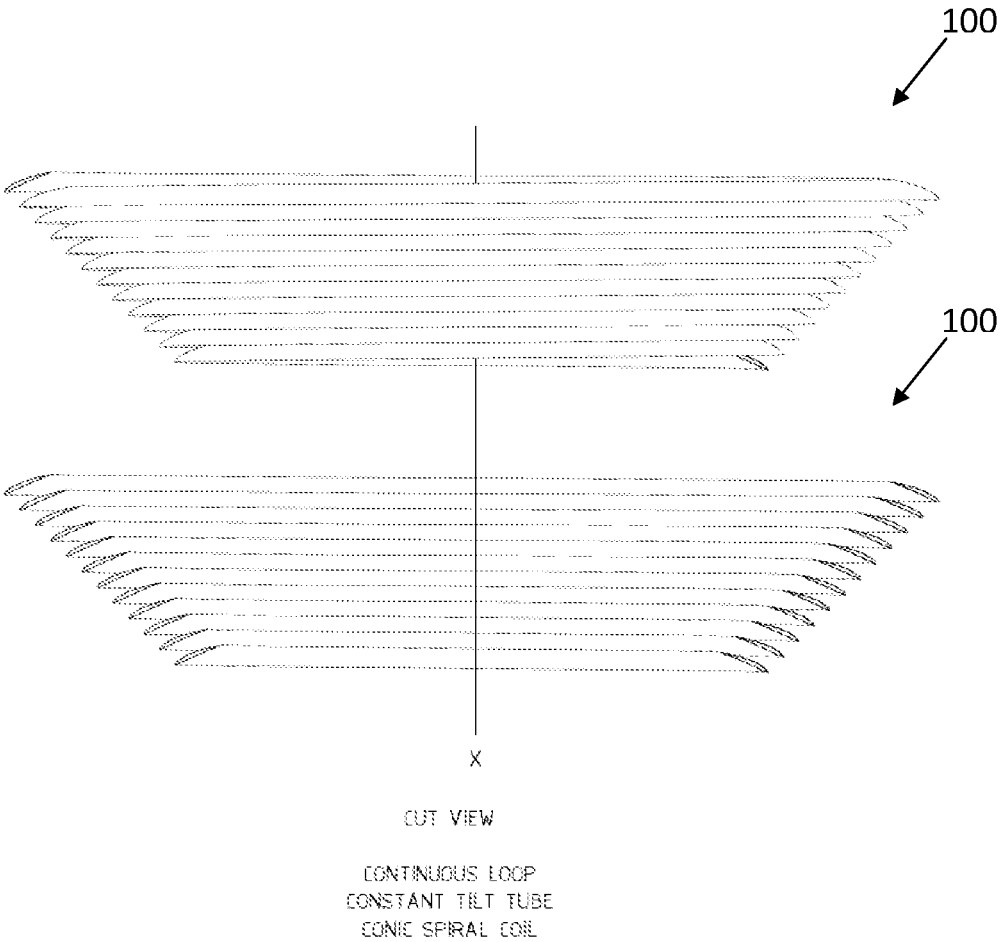
FIG. 7 is a cut elevation view of a constantly tilted tube in a continuous loop forming a conic spiral coil.

FIG. 7 is a cut elevation view of a constantly tilted tube in a continuous loop forming a conic spiral coil.

Figure 8:
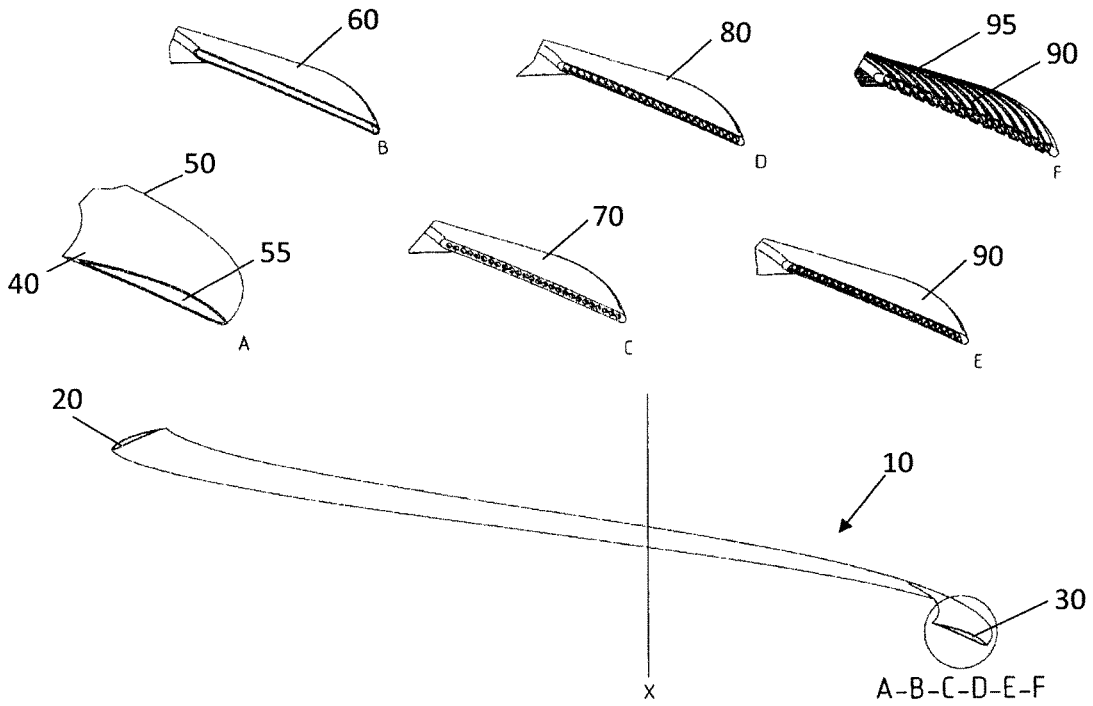
FIG. 8 is a perspective view of a tubing element with several alternatives for the internal structure of the tubing element.

FIG. 8 is a perspective view of a tubing element with several alternatives for the internal structure of the tubing element. As can be seen in alternative A, only one channel may be provided which is defined by the side walls 40, 50 and the connecting walls 45, 55. As can be further derived from this detail A, the distance between the first side wall 40 and the second side wall 50 is considerably smaller than the width of the first side wall 40 and the second side wall 50 resulting in a substantially overall flat tubing structure of the tubing element 10. Exemplarily, the width of the first side wall 40 and the second side wall 50 is approximately at least ten times larger than the distance between the first side wall 40 and the second side wall 50.

Furthermore, as shown in detail B, there may be also several microchannels 60 with a circular cross-section.

Alternatively, as shown in detail C, there may be also several microchannels 70 with an angular cross-section, i.e. quadrangular cross-section.

As shown in detail D, there may be also several microchannels 80 to a triangular cross-section.

As shown in detail E, there may be several microchannels 90 with a quadrangular cross-section, which are arranged with an off-set to each other. In particular, as shown in detail F, all microchannels 90 are arranged with an off-set to each other forming a plurality of grooves 95 on the outer sides of the tubing element 10.

Figure 9:
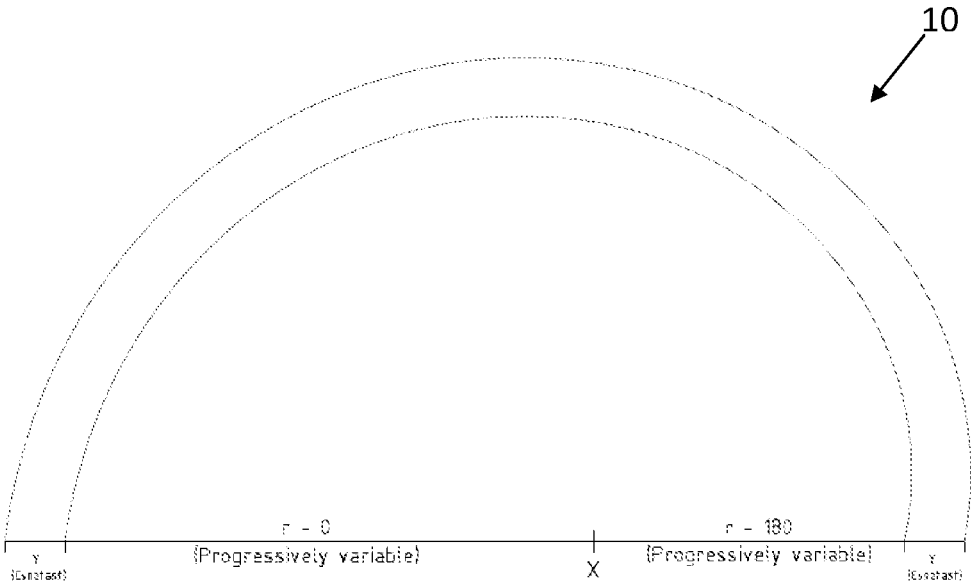
FIG. 9 is a top view of a constantly tilted spiral tubing element.

FIG. 9 shows a half loop of a constantly tilted spiral tubing element 10.

Figure 10:
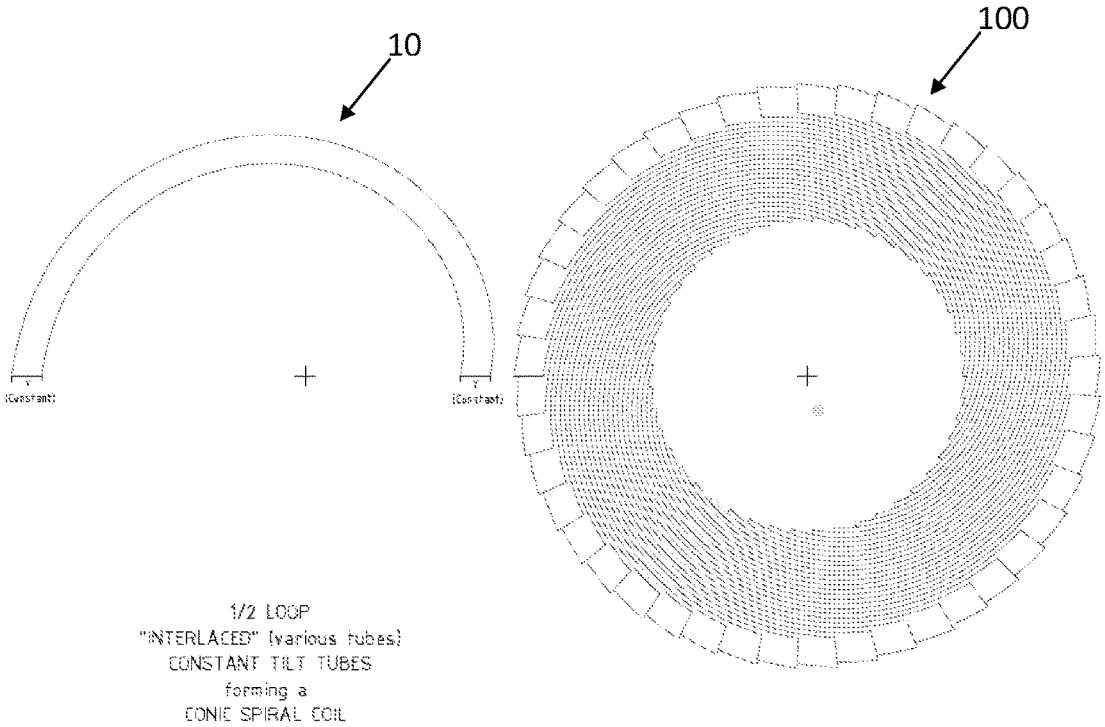
FIG. 10 is a top view comparison of a constantly tilted tubing element and a conic spiral coil formed by various interlaced constantly tilted tubing elements.

FIG. 10 shows a top view of a heat exchanger 100 formed by various interlaced constantly tilted tubing elements 10 that are arranged adjacent to each other.

Figure 11:
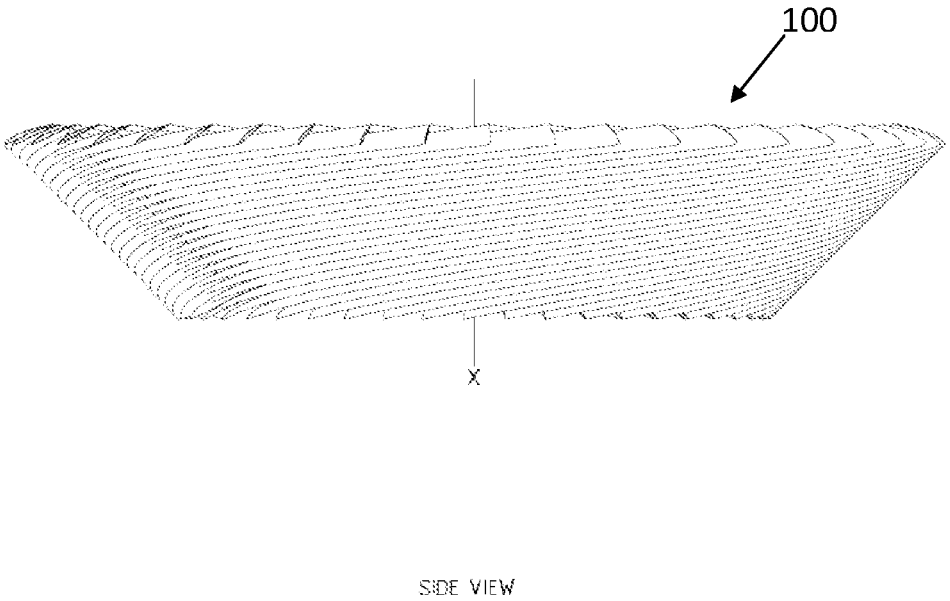
FIG. 11 is a side view of a conic spiral coil formed by various interlaced constantly tilted tubing elements.
Figure 12:
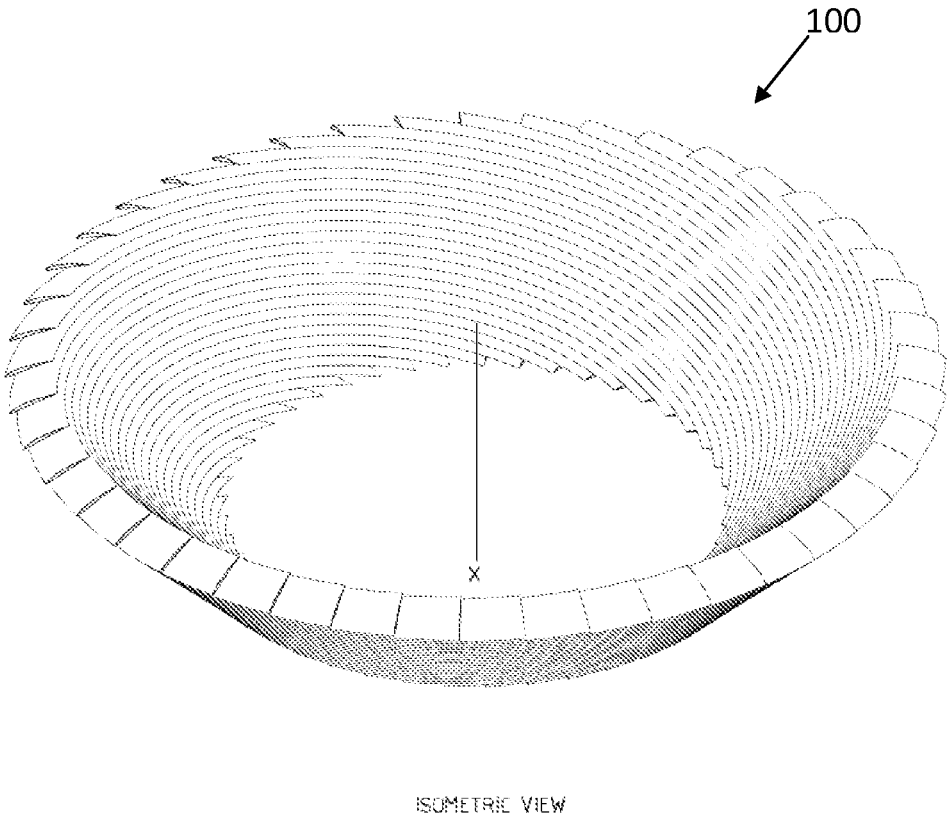
FIG. 12 is an isometric view of a conic spiral coil formed by various interlaced constantly tilted tubing elements.
Figure 13:
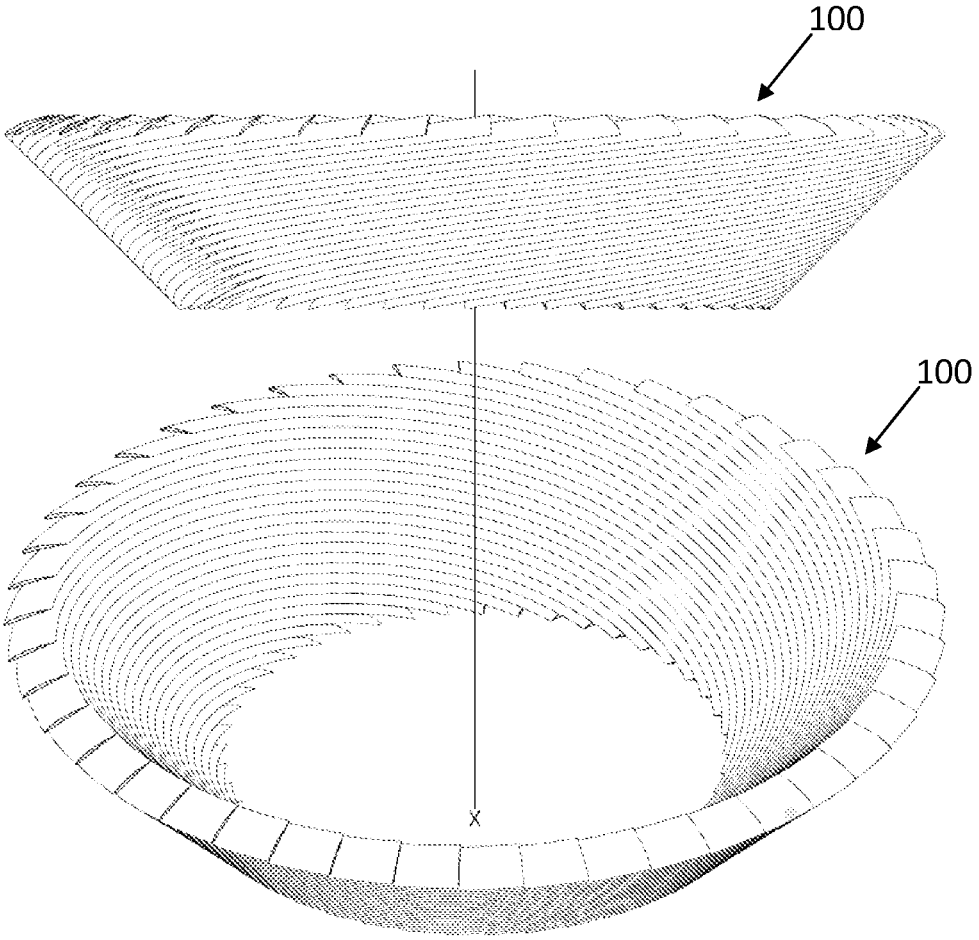
FIG. 13 is a comparison of a side view and an isometric view of a conic spiral coil formed by various interlaced constantly tilted tubing elements.

FIGS. 11-13 show various angles of the heating element 100 in a spiral conic shape.

Figure 14:
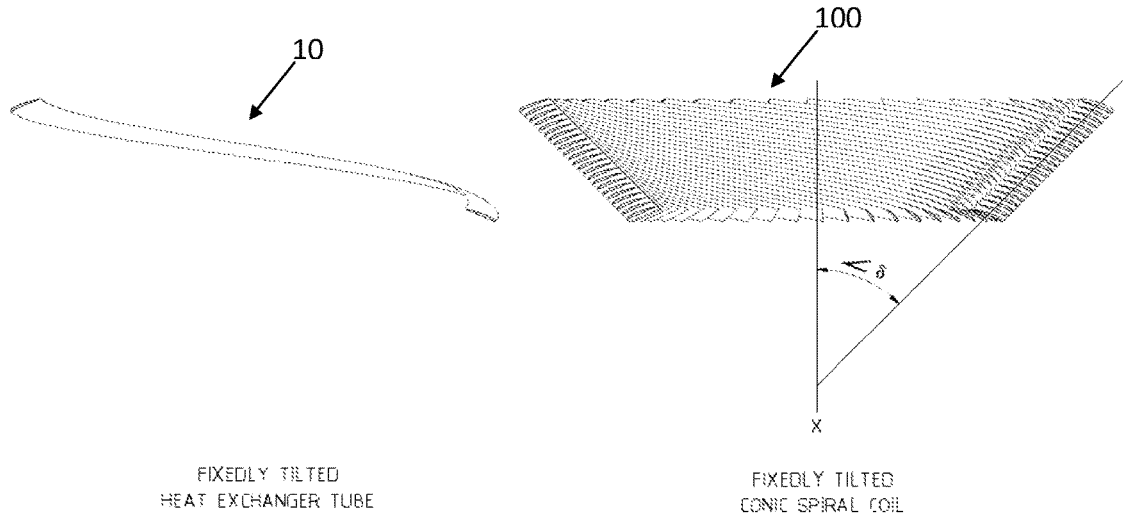
FIG. 14 is a comparison of a continuously tilted tubing element and a cut view of a continuously tilted conic spiral coil.
Figure 15:
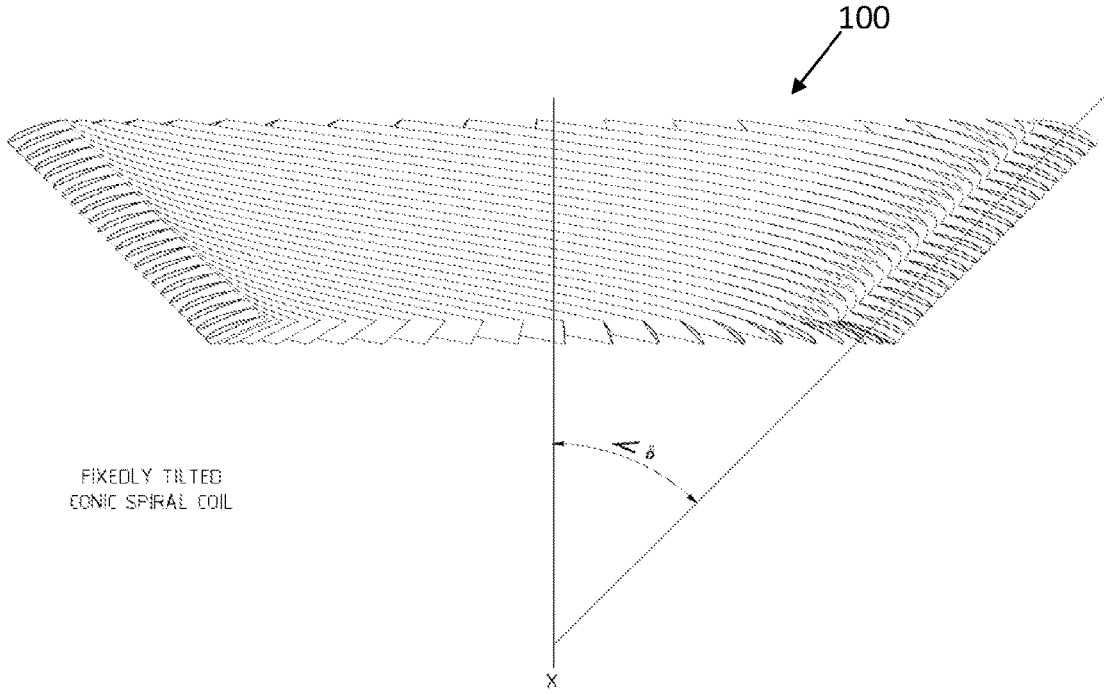
FIG. 15 is a cross-sectional view of a continuously tilted conic spiral coil showing an angle for the tilt of the coil.
Figure 16:
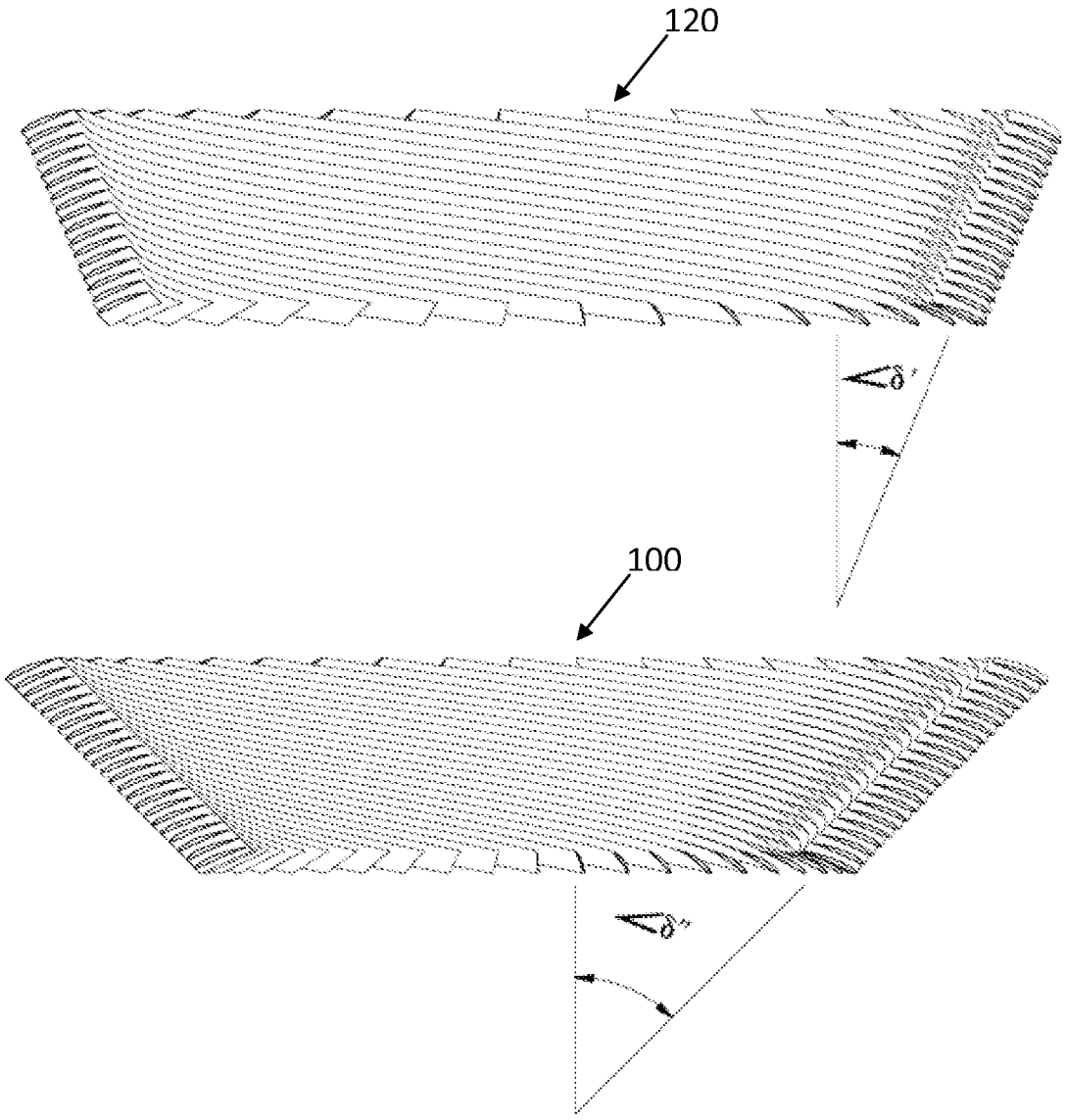
FIG. 16 is a comparison between two continuously tilted conic spiral coil with the same upper diameter and different lower diameters.

FIG. 14 is a comparison of a continuously tilted tubing element 10 and a cut view of a heating element 100 formed from continuously tilted tubing elements 10 in a conic spiral coil, with angle $\delta$ defining the tilt of the heating element coil 100. The diameter of the heating element coil 100 may vary. In some embodiments, the diameter at the top of the heating element 100 is larger than the diameter at the bottom of the coil. FIG. 16 shows two different heating elements 100 with the same upper diameter but different lower diameters. The tilt of the two heating elements 100 varies, as shown by the different between tilt angles $\delta'$ and $\delta''$.

Figure 17:
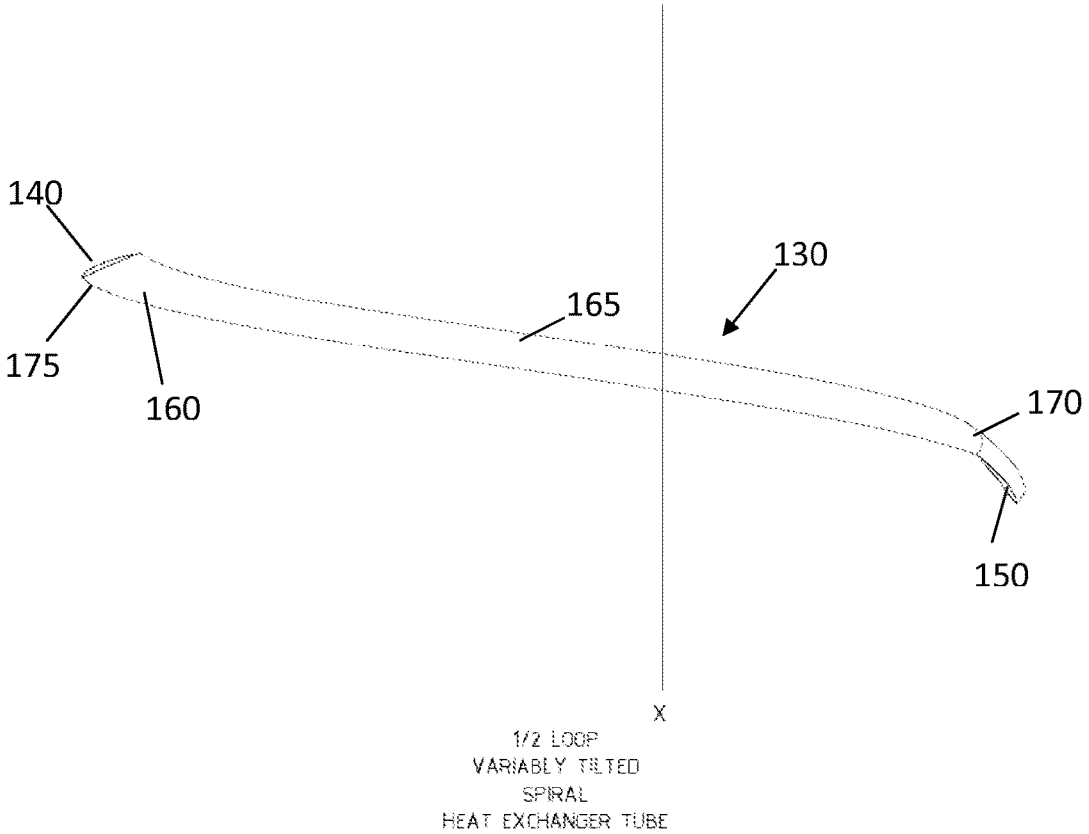
FIG. 17 is a perspective view of a tubing element according to the present invention in a second embodiment of a variably tilted spiral.

FIG. 17 shows the perspective view of a second embodiment of the tubing element 130. The tubing element 130 is a rigid elongated heat exchanger tube, a first end 140 and a second end 150. The tubing element 130 is in a variably tilted spiral shape. The difference between this embodiment and the first embodiment (tubing element 10) is in the tilt angle of the heat exchange coil 100. In the first embodiment, tubing element 130 has a constant tilt angle. In the second embodiment, the tilt angle of tubing element 130 varies throughout the length of the heating element coil 200.

Figure 18:
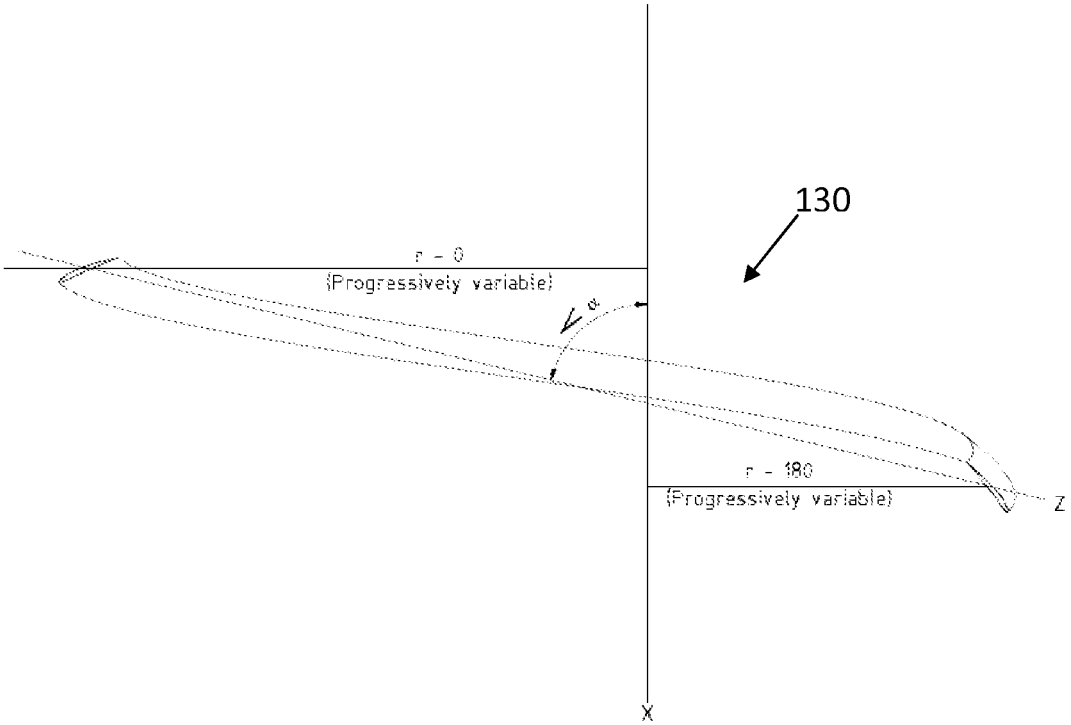
FIG. 18 is a further perspective view of tubing element shown in FIG. 17, showing the radii and angles for the tubing element.
Figure 19:
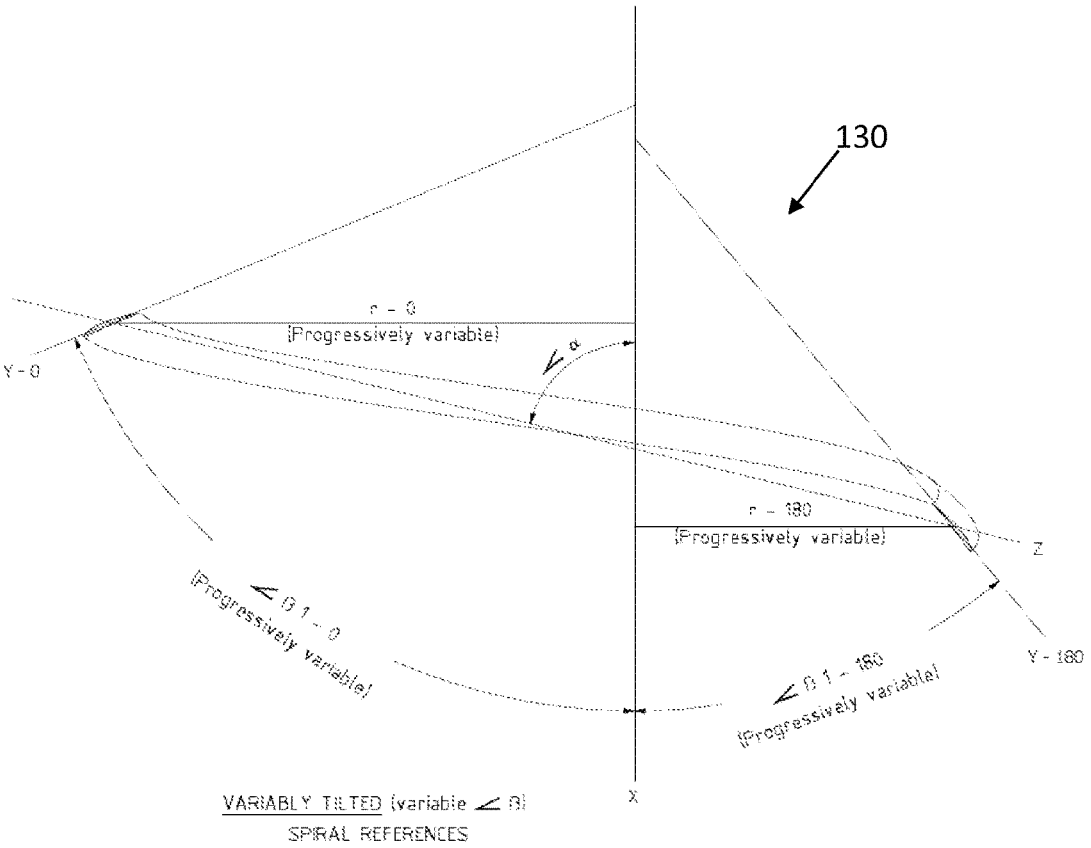
FIG. 19 is a further perspective view of tubing element shown in FIG. 17, showing the angles for the slope and the tilt of the tubing element.
Figure 20:
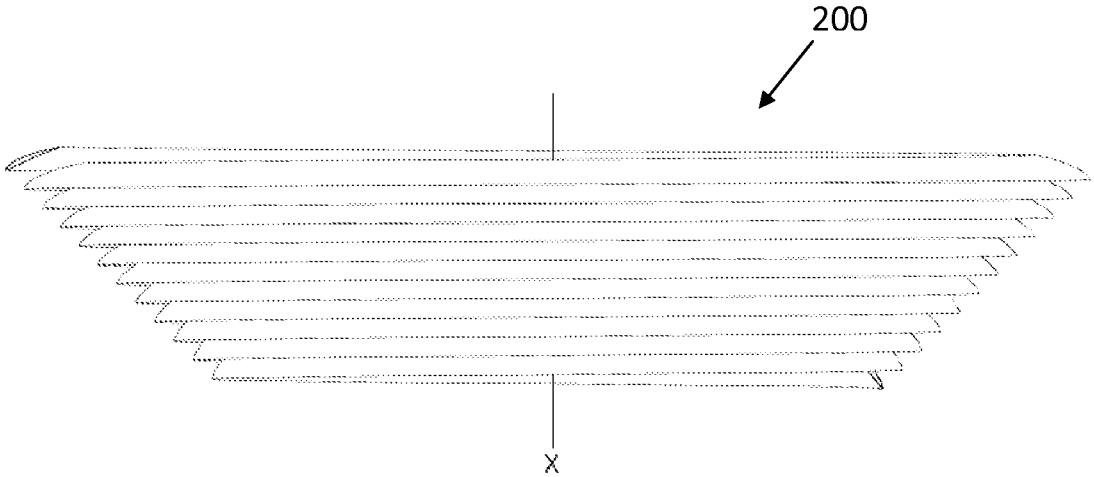
FIG. 20 is a side elevation view of a variably tilted tube in a continuous loop forming a conic spiral coil.
Figure 21:
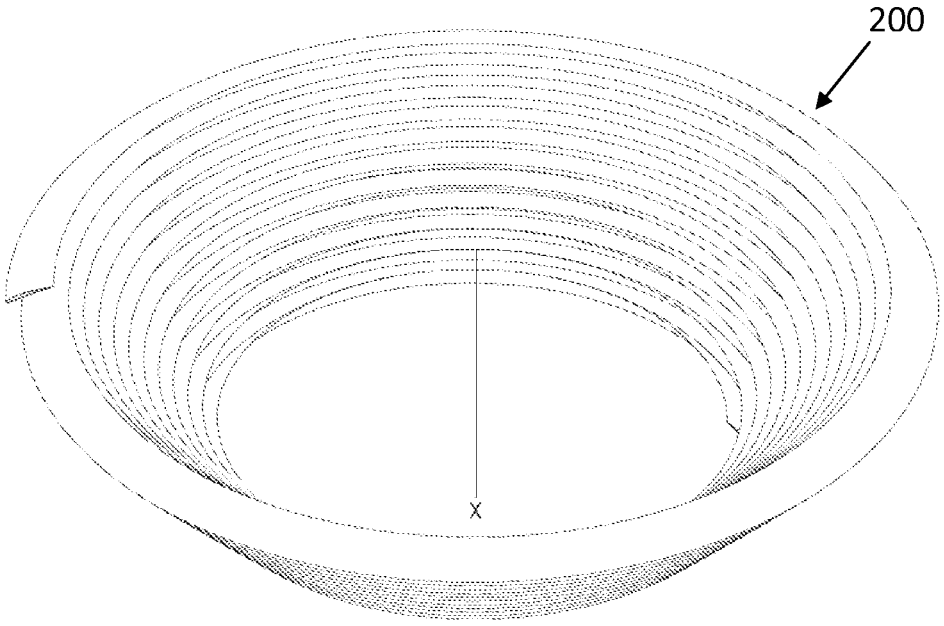
FIG. 21 is an isometric view of a variably tilted tube in a continuous loop forming a conic spiral coil.
Figure 22:
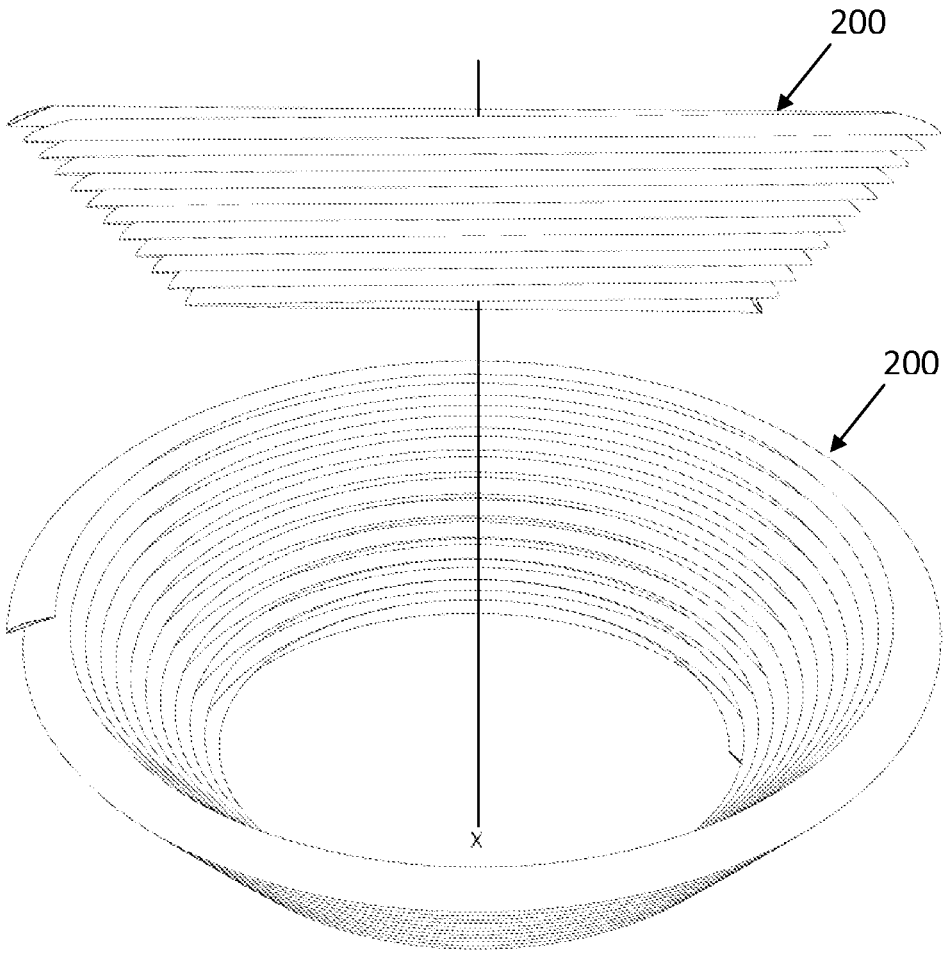
FIG. 22 shows a comparison of the side elevation and isometric views of a variably tilted tube in a continuous loop forming a conic spiral coil.
Figure 23:
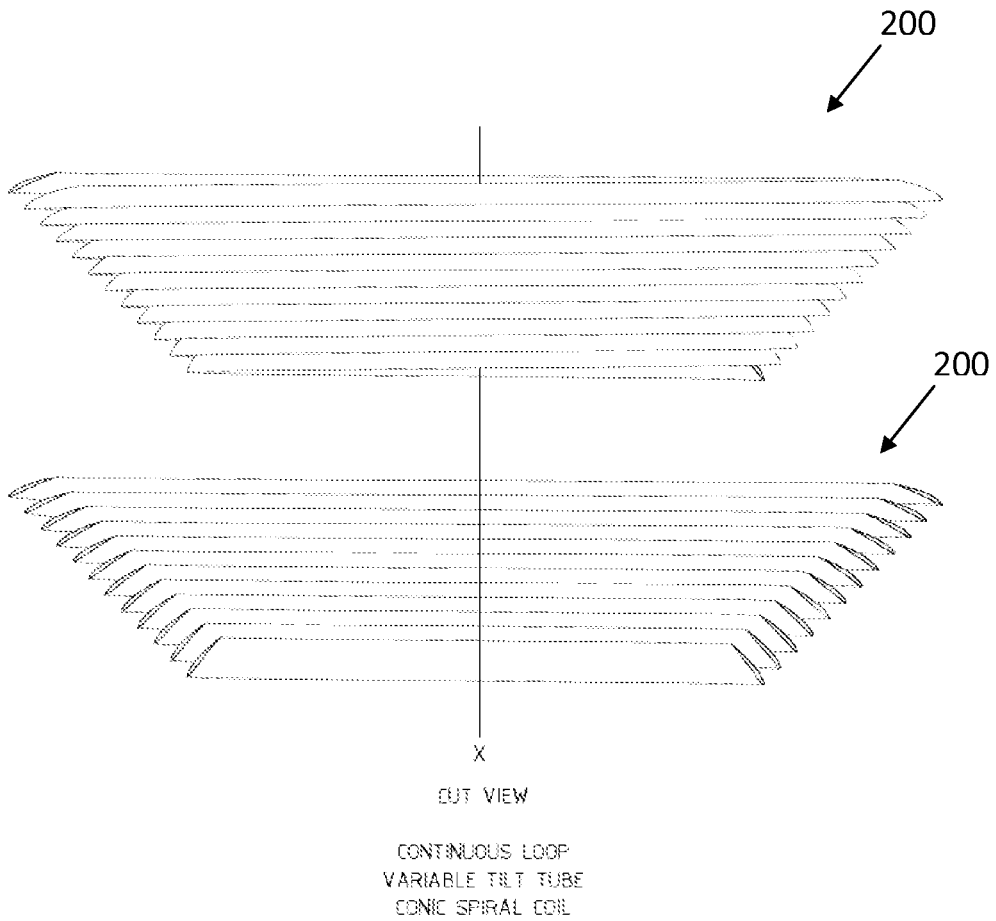
FIG. 23 is a cut elevation view of a variably tilted tube in a continuous loop forming a conic spiral coil.

FIG. 18 is a perspective view of tubing element shown in FIG. 17 showing the radii and angles for the of the tubing element 130, and FIG. 19 is a further perspective view of tubing element 130 shown in FIG. 17, showing the angles for the slope and the tilt of the tubing element.

As in the first embodiment, there are relatively large parallel opposite side walls 160 and 170 with generally flat surfaces. The opposite parallel arranged side walls 160, 170 of the tubing element are joined with relatively small opposite edge walls 165, 175, which are rounded connection walls 165, 175. The tubing element 130 is partially tilted and also helically wound and/or twisted so as to form at least a part of a conic spiral structure.

The opening at ends 140 and 150 is varies in width and has the smallest opening distance near the connecting walls 165 and 175. The width of the opening between the first side wall 160 and the second side wall 170 is considerably smaller than the width of the side walls 160, 170.

FIGS. 20-23 show various angles of the heating element 100 in a spiral conic shape.

Figure 24:
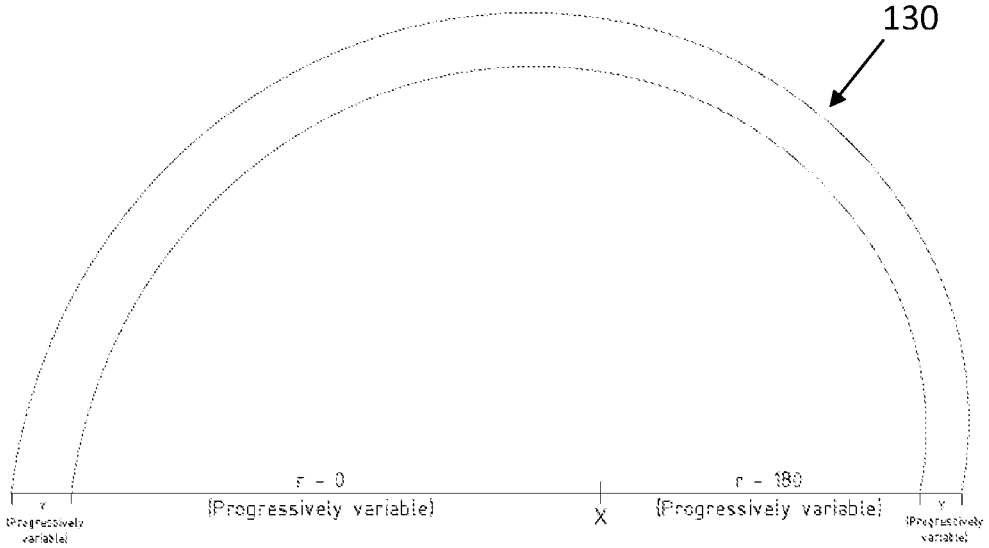
FIG. 24 is a top perspective view of a variably tilted tubing element.
Figure 25:
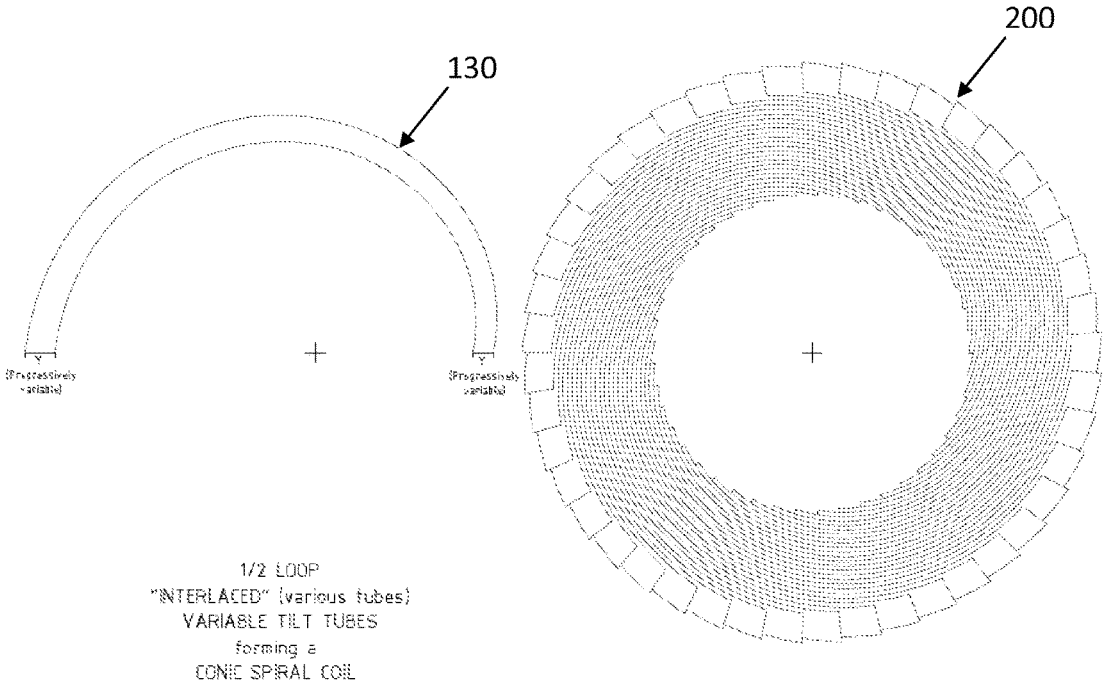
FIG. 25 is a top view comparison of a variably tilted tubing element and a conic spiral coil formed by various interlaced variably tilted tubing elements.
Figure 26:
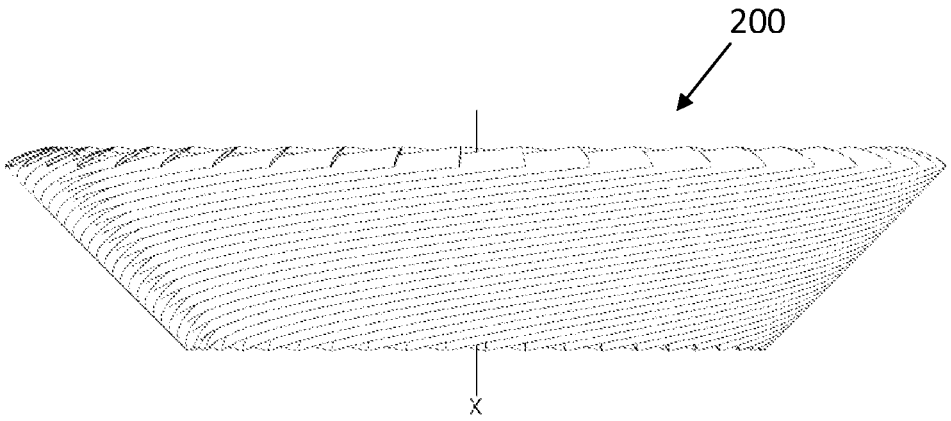
FIG. 26 is a side view of a conic spiral coil formed by various interlacing variably tilted tubing elements.
Figure 27:
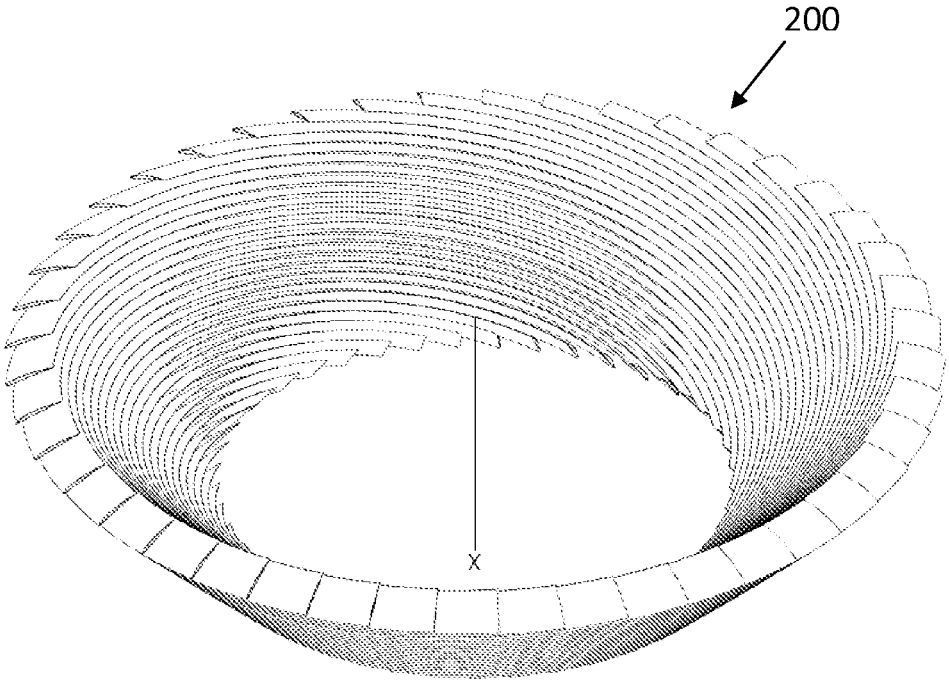
FIG. 27 is an isometric view of a conic spiral coil formed by various interlaced variably tilted tubing elements.
Figure 28:
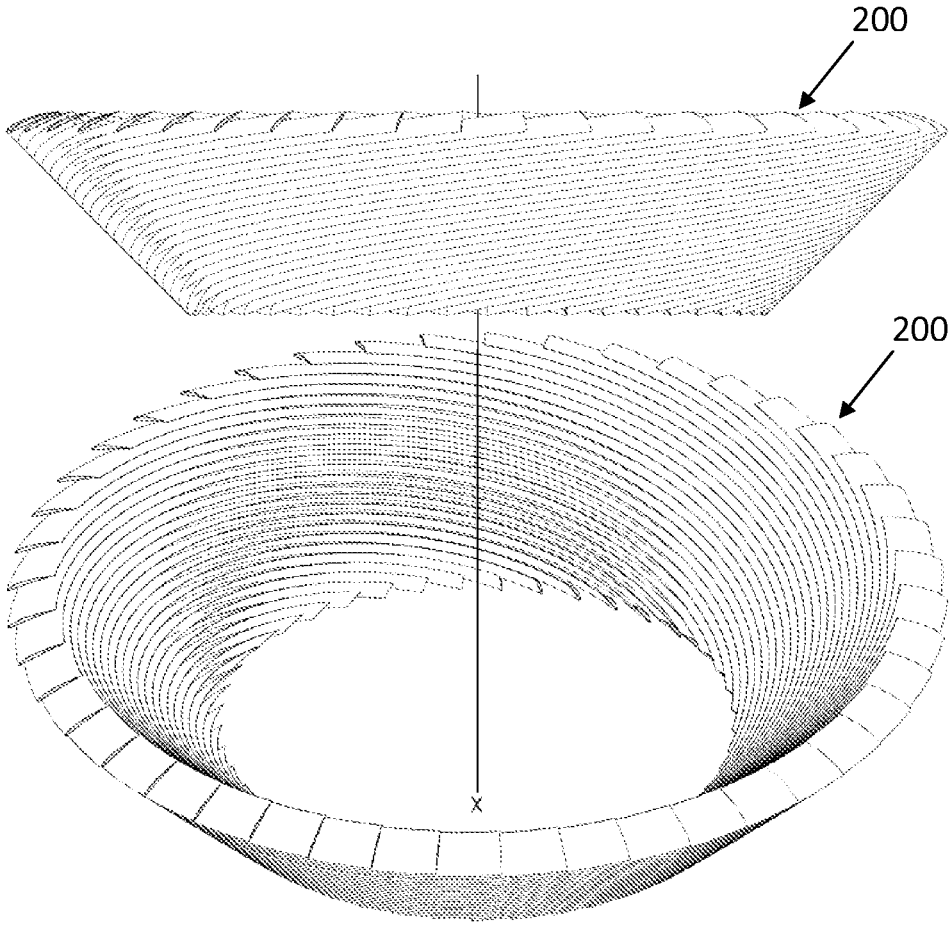
FIG. 28 is a comparison of a side view and an isometric view of a conic spiral coil formed by various interlaced variably tilted tubing elements.
Figure 29:
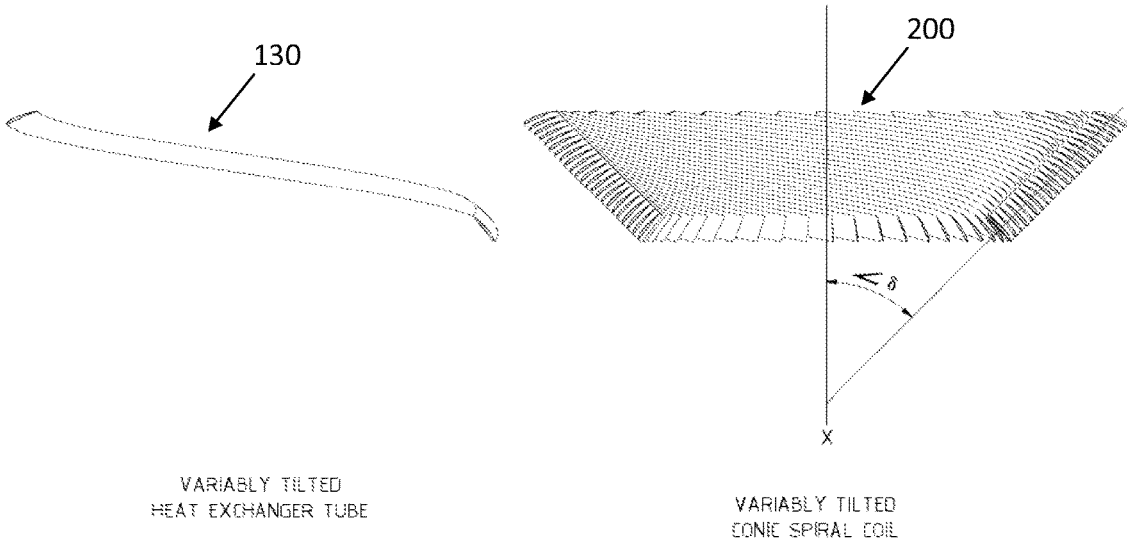
FIG. 29 is a comparison of a variably tilted tubing element and a cut view of a variably tilted conic spiral coil.

FIG. 24 shows a half loop of a constantly tilted spiral tubing element 130, and FIG. 25 shows a top view of a heat exchanger 200 formed by various interlaced constantly tilted tubing elements 130 that are arranged adjacent to each other.

FIGS. 26-29 show various angles of the heating element 200 that is formed by variable tilt element tubes 130 interlaced in a spiral conic shape.

Figure 30:
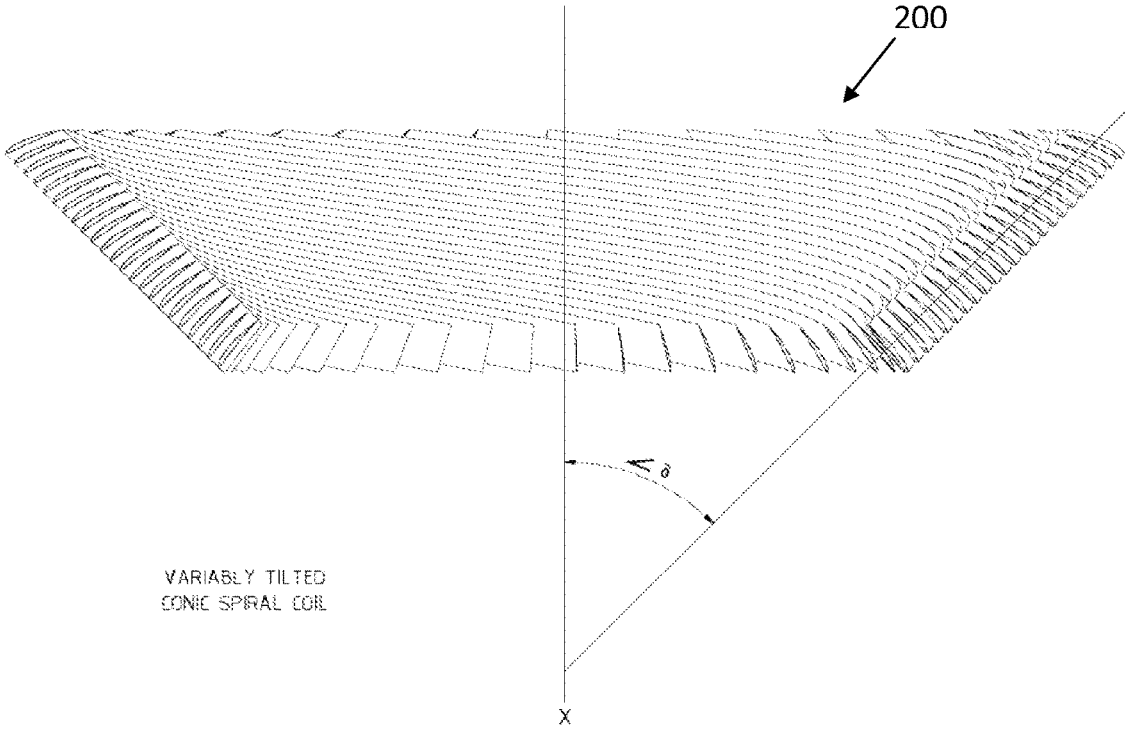
FIG. 30 is a cross-sectional view of a variably tilted conic spiral coil showing an angle for the tilt of the coil.

FIG. 30 is shows a cut view of a heating element 200 formed from variably tilted tubing elements 130 in a conic spiral coil, with angle δ defining the tilt of the heating element coil 100.

Figure 31:
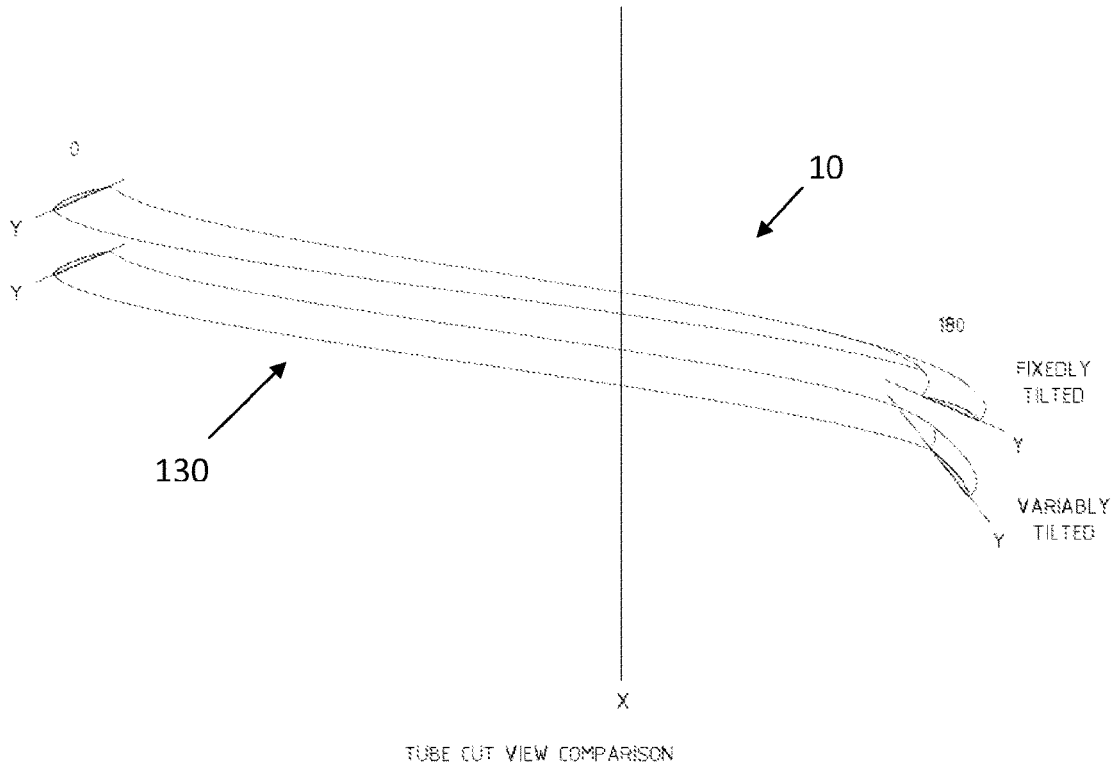
FIG. 31 is a comparison of a continuously tilted tubing element and a twisted and variably tilted tubing element.
Figure 32:
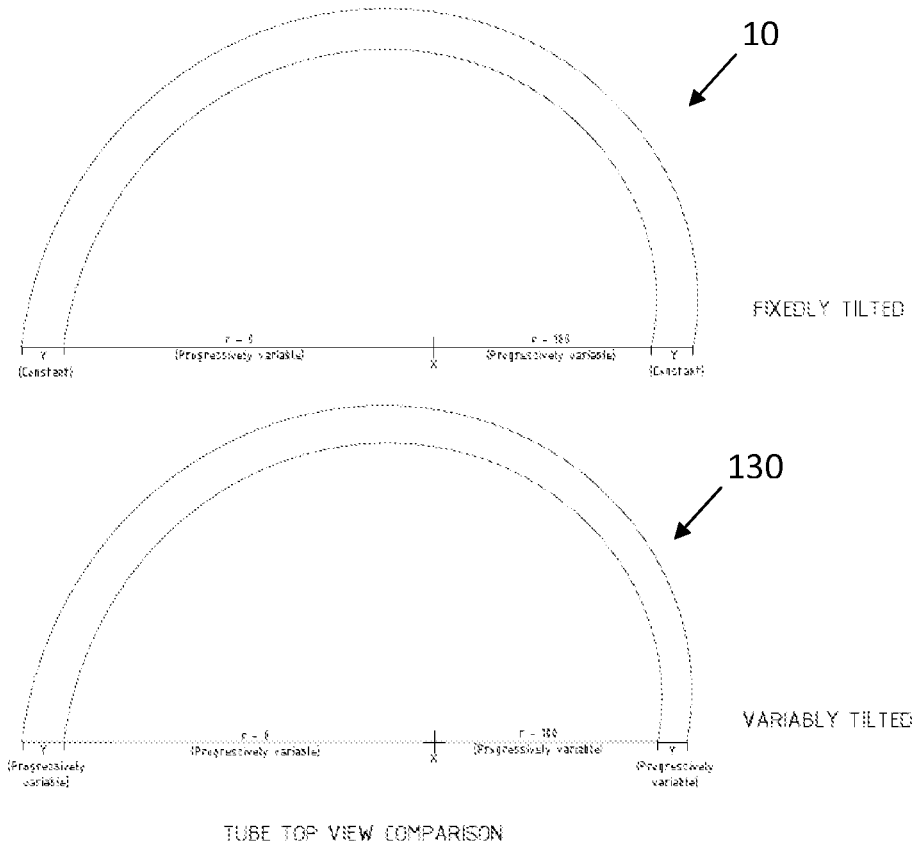
FIG. 32 is a top view comparison of a continuously tilted tubing element and a twisted and variably tilted tubing element.
Figure 33:
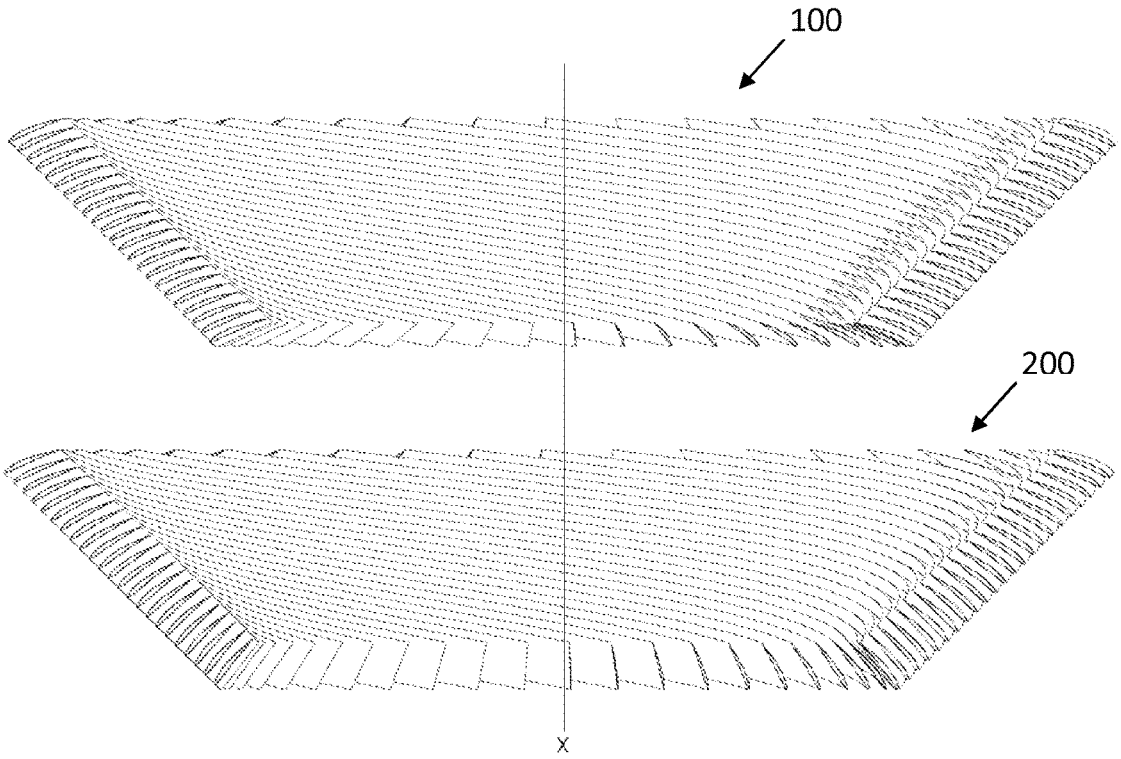
FIG. 33 is a cut view comparison of a continuously tilted tubing element forming a spiral conic coil and a twisted and variably tilted tubing element forming a spiral conic coil.

FIG. 31 shows two different tubing elements 10 and 130 which have different tilt angles. Tubing element 10 is continuously tilted as and tubing element 130 has a variable tilt angle. This difference is seen from a top view of half loops of tubing elements 10 and 130 in FIG. 32 and a cut view of tubing elements 10 and 130 forming a heating element 100 and 200, respectively, in FIG. 33.

Figure 34:
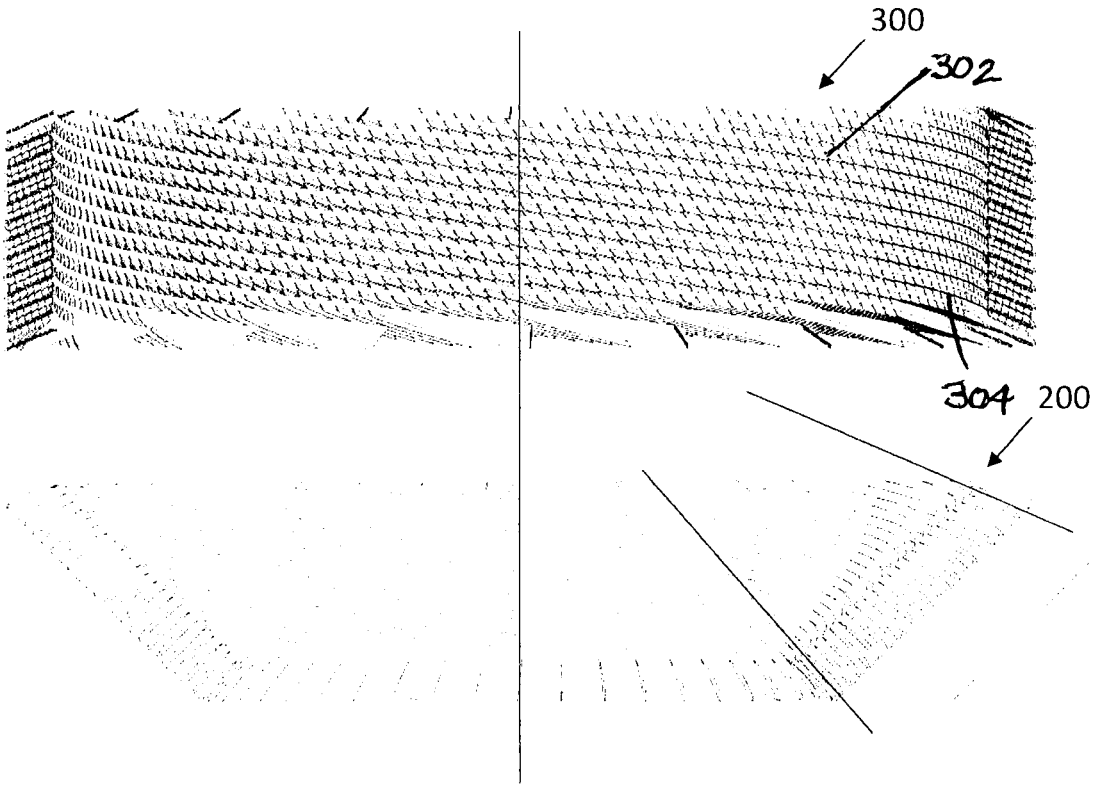
FIG. 34 is a comparison of a helical heat exchanger and a conic spiral shaped heat exchanger.

FIG. 34 is a comparison of a helical heat exchanger 300, where in the top the spiral is formed as a cylinder around the longitudinal central axis along with fins 302 with covers 304 between the outer surfaces of adjacent tubes, and a conic spiral shaped heat exchanger 200. The heat conic spiral shaped heat exchanger 200 may offer a larger surface area than the helical heat exchanger and may also allow more balanced heat dissipation.

While the invention has been described with reference to specific embodiments, modifications and variations of the invention may be constructed without departing from the scope of the invention, which is defined in the following claims.

I claim:

1. Apparatus comprising a heat exchanger, further comprising a long tube having a cross-section that is relatively wide and relatively thin, having an inner space, outer side surfaces that are relatively wide and edge surfaces that are relatively narrow between the side surfaces, the tube having a first end and a second end adapted for passing a first heat exchange fluid into the first end through the tube and out through the second end and flowing a second heat exchange fluid over the outer side surfaces, wherein the tube is progressively variably tilted continuously along an entire length of the tube and formed into a spiral about a longitudinal central axis with spaced portions of the outer side surfaces of the tube for flowing the second heat exchange fluid in spaces formed between the spaced portions of the outer side surfaces of the tube.

2. The apparatus of claim 1, wherein the spiral is formed as a cylinder around the longitudinal central axis.

3. The apparatus of claim 1, wherein the spiral is formed about the central axis and the tube is constantly receding from or moving towards the central axis.

4. The apparatus of claim 3, wherein the spiral is formed as a conical shape having spaces between the spaced portions of the outer side surfaces.

5. The apparatus of claim 4, wherein the spaced portions of the outer side surfaces of the long tube extend through the conical shape.

6. Apparatus comprising a heat exchanger, further comprising a long tube having a cross-section that is relatively wide and relatively thin, having an inner space, outer side surfaces that are relatively wide and edge surfaces that are relatively narrow between the side surfaces, the tube having a first end and a second end adapted for passing a first heat exchange fluid into the first end through the tube and out through the second end and flowing a second heat exchange fluid over the outer side surfaces, wherein the tube is progressively variably tilted continuously along an entire length of the tube and formed into a spiral about a longitudinal central axis with spaced portions of the outer side surfaces of the tube for flowing the second heat exchange fluid in spaces formed between the spaced portions of the outer side surfaces of the tube, wherein the long tube is twisted around a longitudinal axis of the tube, wherein slope angles of portions of the outer side surfaces of the tube vary with respect to the longitudinal central axis of the conical shape.

7. The apparatus of claim 6, wherein the angles of the slope vary according to positions of the portions of the outer side surfaces with respect to the central axis.

8. The apparatus of claim 4, wherein the conical shape has a first smaller diameter end and a second larger diameter end, and wherein the portions of the outer side surfaces near the first smaller diameter end form smaller acute angles to the longitudinal central axis of the conical shape, and the portions of the outer side surfaces adjacent the second larger diameter end form larger acute angles with respect to the longitudinal central axis, so that the outer side surfaces are more nearly parallel with the longitudinal central axis near the smaller diameter end and that the outer side surfaces are more nearly perpendicular to the longitudinal central axis near the larger diameter end.

9. The apparatus of claim 8, wherein the second heat transfer fluid flows inward through the spaces portions between the outer side surfaces in the conical shape of the tube in the conical shape near the first end in a direction more axial than radial to the longitudinal central axis, and wherein the second heat transfer fluid flows inward through the spaces portions between the outer side surfaces in the conical shape near the second end in a direction more radial than axial to the longitudinal central axis.

10. The apparatus of claim 8, wherein angles of the portions of the outer side surfaces nearer the first smaller diameter end of the conical shape are more axial to the longitudinal central axis, and wherein angles of the portions of the outer side surfaces nearer the second larger diameter end of the conical shape are more radial than axial to the longitudinal central axis.

11. The apparatus of claim 10, further comprising multiple interlaced tubes having similar shapes extending parallel to and spaced from each other, having first ends of the tubes near the first smaller end of the conical shape, and having second ends of the tubes near the second larger end of the conical shape.

12. The apparatus of claim 11, wherein the multiple interlaced tubes have air foil shaped surfaces with rounded leading edges of the edge surfaces facing outward from the conical shape, increased thickness central portions and tapered trailing edges facing inward in the conical shape.

13. The apparatus of claim 11, wherein the multiple interlaced tubes have rectangular cross-sections with rounded outward leading edges and rounded inward trailing edges.

14. The apparatus of claim 11, wherein the multiple interlaced tubes have inward sloped dividers forming inner micro channels in the tubes.

15. The apparatus of claim 11, wherein the multiple interlaced tubes have inward extending outer surfaces joined together at spaced positions along widths of the tubes and forming inner micro channels and outer channels between the inner micro channels.

16. The apparatus of claim 11, further comprising fins connected to the outer side surfaces of the tubes and extending into the spaces between the tubes.

17. The apparatus of claim 16, wherein the fins are angularly positioned with respect to longitudinal directions of the tubes.

18. The apparatus of claim 16, further comprising covers on the fins, wherein the covers are spaced from the outer side surfaces of the tubes.

19. The apparatus of claim 18, wherein the covers are parallel to the outer side surfaces of the tubes.

20. The apparatus of claim 11, wherein each of the multiple tubes extends around a fraction of a complete 360° turn around the conical structure.

21. Apparatus comprising a heat exchanger, further comprising multiple interlaced long tubes having cross-sections that are relatively wide and relatively thin, the tubes having inner spaces, outer side surfaces being relatively wide and edge surfaces being relatively narrow, the long tubes having first ends and second ends adapted for passing a first heat exchange fluid into the first ends, through the tubes and out of the second ends, wherein the interlaced tubes are progressively variably tilted continuously along entire lengths of the tubes and formed into a spiral having a central longitudinal axis, and wherein outer side surfaces of the interlaced tubes are spaced apart and are tilted with respect to the central axis for flowing the second heat exchange fluid over the spaced outer side surfaces and through spaces formed between the outer side surfaces of the tubes.

22. The apparatus of claim 21, wherein the spiral is formed as a cylinder around the longitudinal central axis.

23. The apparatus of claim 21, wherein the spiral is formed about and constantly receding from or moving towards the longitudinal central axis.

24. The apparatus of claim 23, wherein the spiral is formed in a conical shape, and wherein the outer surfaces of the long multiple interlaced tubes extend through the conical shape.

25. The apparatus of claim 21, wherein the long tubes are twisted around longitudinal axes of the tubes, wherein angles of slopes of portions of the outer side surfaces of the tubes vary with respect to varied positions along the longitudinal central axis of the conical shape, wherein the conical shape has a first smaller diameter end and a second larger diameter end, and wherein the portions of the outer side surfaces near the first smaller diameter end are at smaller acute angles to the central axis and the portions of the outer surfaces near the second larger diameter end are at larger acute angles with respect to the longitudinal central axis, wherein angles of the portions of the outer side surfaces nearer the first smaller diameter end of the conical shape are more axial than radial to the central axis, and wherein angles of the portions of the outer side surfaces nearer the second larger diameter end of the conical shape are more radial than axial to the longitudinal central axis, whereby the second heat transfer fluid flows inward through spaces between outer side surfaces of the tubes near the first smaller diameter end of the conical shape in a direction more axial than radial to the longitudinal central axis, and wherein the second heat transfer fluid flows inward through spaces between outer side surfaces near the second larger diameter end of the conical shape in a direction more radial than axial to the central axis.

26. A method comprising providing a heat exchanger, further comprising providing multiple spaced apart interlaced long tubes having cross-sections that are relatively wide and relatively thin, the tubes having inner spaces, relatively wide outer side surfaces and relatively narrow outer edge surfaces and having first ends and second ends tilting the interlaced tubes and forming the interlaced tubes into a spiral shape, a central longitudinal axis, and having a smaller first end and a larger second end, outer side surfaces of the interlaced tubes are spaced apart and the tubes are progressively variably tilted continuously along entire lengths of the tubes, passing a first heat exchange fluid into the first ends, through the tubes and out of the second ends, flowing the second heat exchange fluid over the spaced outer side surfaces and through spaces formed between the spaced outer side surfaces of the tubes and in a direction of the central axis and outward through the second larger end.

27. The method of claim 26, wherein the tilting further comprises tilting the outer side surfaces of the tubes with respect to the central axis.

28. The method of claim 26, further comprising twisting the long tubes about longitudinal axes of the tubes before interlacing the tubes.

29. The method of claim 26, wherein the tilting further comprises varying the tilting of the outer side surfaces.

30. The method of claim 29, wherein the tilting further comprises tilting the outer side surfaces of the tube at increasing obtuse angles and decreasing acute angles from the larger second end to the smaller first end.

31. The method of claim 26, further comprising providing the interlaced tubes in a spiral having a conical shape.

* * * * *